US010589556B2

(12) United States Patent
Bollström et al.

(10) Patent No.: US 10,589,556 B2
(45) Date of Patent: Mar. 17, 2020

(54) PRINTED WATERMARK

(71) Applicant: Omya International AG, Oftringen (CH)

(72) Inventors: Roger Bollström, Zofingen (CH); Patrick A. C. Gane, Rothrist (CH); Joachim Schoelkopf, Oberkulm (CH)

(73) Assignee: Omya International AG, Oftringen (CH)

( * ) Notice: Subject to any disclaimer, the term of this patent is extended or adjusted under 35 U.S.C. 154(b) by 0 days.

(21) Appl. No.: 15/776,981

(22) PCT Filed: Nov. 11, 2016

(86) PCT No.: PCT/EP2016/077407
§ 371 (c)(1),
(2) Date: May 17, 2018

(87) PCT Pub. No.: WO2017/089148
PCT Pub. Date: Jun. 1, 2017

(65) Prior Publication Data

US 2018/0333975 A1 Nov. 22, 2018

Related U.S. Application Data

(60) Provisional application No. 62/261,352, filed on Dec. 1, 2015.

(30) Foreign Application Priority Data

Nov. 24, 2015 (EP) ..... 15196143

(51) Int. Cl.
*B41M 3/14* (2006.01)
*D21H 21/30* (2006.01)
(Continued)

(52) U.S. Cl.
CPC ..... *B41M 3/144* (2013.01); *B42D 25/387* (2014.10); *B65D 65/40* (2013.01); *D21H 17/09* (2013.01);
(Continued)

(58) Field of Classification Search
CPC ..... B41M 3/144; B41M 7/00; D21H 21/28; D21H 17/09; D21H 17/675; D21H 27/10;
(Continued)

(56) References Cited

U.S. PATENT DOCUMENTS

2005/0031838 A1 2/2005 Lagunowich et al.
2007/0264476 A1 11/2007 Bala et al.
(Continued)

FOREIGN PATENT DOCUMENTS

EP 1712523 A1 10/2006
EP 1712597 A1 10/2006
(Continued)

OTHER PUBLICATIONS

International Search Report dated Feb. 21, 2017 from PCT/EP2016/077407.
(Continued)

*Primary Examiner* — Bradley W Thies
(74) *Attorney, Agent, or Firm* — Arrigo, Lee, Guttman & Mouta-Bellum LLP; Harry J. Guttman

(57) ABSTRACT

The present invention relates to a method of manufacturing a substrate with an embedded, UV-visible pattern, wherein a liquid treatment composition comprising at least one acid is deposited onto a substrate, which comprises at least one optical brightener and optionally a filler, wherein the filler comprises 0 to 60 wt.-% of a salifiable alkaline or alkaline earth compound, based on the total weight of the substrate.

20 Claims, 3 Drawing Sheets

(51) Int. Cl.

| | |
|---|---|
| ***D21H 21/48*** | (2006.01) |
| ***B65D 65/40*** | (2006.01) |
| ***D21H 27/10*** | (2006.01) |
| ***B42D 25/387*** | (2014.01) |
| ***D21H 17/09*** | (2006.01) |
| ***D21H 17/67*** | (2006.01) |
| ***D21H 21/28*** | (2006.01) |
| ***B41M 7/00*** | (2006.01) |
| ***B42D 25/333*** | (2014.01) |
| ***B42D 25/355*** | (2014.01) |
| ***B42D 25/425*** | (2014.01) |
| ***B42D 25/45*** | (2014.01) |

(52) U.S. Cl.
CPC ..... *D21H 17/675* (2013.01); *D21H 21/28* (2013.01); *D21H 21/30* (2013.01); *D21H 21/48* (2013.01); *D21H 27/10* (2013.01); *B41M 7/00* (2013.01); *B42D 25/333* (2014.10); *B42D 25/355* (2014.10); *B42D 25/425* (2014.10); *B42D 25/45* (2014.10)

(58) Field of Classification Search
CPC ..... D21H 21/48; D21H 21/30; B42D 25/387; B42D 25/355; B42D 25/333; B42D 25/45; B42D 25/425; B65D 65/40
See application file for complete search history.

(56) References Cited

U.S. PATENT DOCUMENTS

| | | | | |
|---|---|---|---|---|
| 2012/0031576 | A1 | 2/2012 | Gane et al. | |
| 2013/0027723 | A1* | 1/2013 | Coyle ..... | B41M 3/008 358/1.9 |
| 2014/0151996 | A1 | 6/2014 | Camus | |
| 2017/0065974 | A1* | 3/2017 | Bollstrom ..... | D21H 19/38 |

FOREIGN PATENT DOCUMENTS

| | | | |
|---|---|---|---|
| EP | 1967377 | A2 | 9/2008 |
| EP | 2159258 | A1 | 3/2010 |
| EP | 2264108 | A1 | 12/2010 |
| EP | 2264109 | A1 | 12/2010 |
| EP | 2371766 | A1 | 10/2011 |
| EP | 2447213 | A1 | 5/2012 |
| EP | 2524898 | A1 | 11/2012 |
| JP | H02194989 | A | 8/1990 |
| TW | 379268 | | 1/2000 |
| WO | 0039222 | A1 | 7/2000 |
| WO | 2005121257 | A1 | 12/2005 |
| WO | 2008024542 | A1 | 2/2008 |
| WO | 2009074492 | A1 | 6/2009 |
| WO | 2013142473 | A1 | 9/2013 |

OTHER PUBLICATIONS

Written Opinion of the International Searching Authority dated Feb. 21, 2017 from PCT/EP2016/077407.
English Language Abstract of TW379268 from Taiwan Patent Office (2 pages).

* cited by examiner

PRINTED WATERMARK

CROSS-REFERENCE TO RELATED APPLICATIONS

This is a U.S. national phase of PCT Application No. PCT/EP2016/077407, filed Nov. 11, 2016, which claims priority to U.S. Provisional Application No. 62/261,352, filed Dec. 1, 2015 and European Application No. 15196143.0, filed Nov. 24, 2015.

The present invention relates to a method of manufacturing a substrate with an embedded pattern, which is observable under UV light, a substrate obtainable by said method and its use.

Paper and paper-like products may be marked with an identifying image or pattern by incorporating watermarks, or using techniques such as stamping, punching, or embossing. Such markings may be useful for a variety of applications such as ticket validation, anti-counterfeiting, individualisation, or for decorative purposes.

With the improvements in desktop publishing and colour-photocopiers, the opportunities for document fraud have increased dramatically. Consequently, there is also an increasing demand for markings or tags, which can be used to verify the authenticity of a document, e.g., a passport, a driving licence, bank card, credit card, vouchers, tax banderols, stamps, certificate, or means of payment. Moreover, paper manufactures have to contend with the problem that in particular their label papers and packaging papers are used in counterfeited products. Thus, there is an increasing need for methods for discretely tagging paper materials and methods to verify the origin of paper materials found in counterfeited products.

US 2005/0031838 A1 describes a taggant security system for paper products comprising the incorporation of taggants such as fluorescent dyers or phosphors. However, the inclusion of such taggants can lead to problems during paper production such as repulping.

WO 2008/024542 A1 describes a method, wherein a reflective feature is formed by a direct-write printing process using an ink comprising metallic particles.

US 2014/0151996 A1 relates to security elements with an optical structure making it possible to vary the appearance of the security element when the viewing angle is modified. However, these security elements are visible to the naked eye under specific conditions, and thus, can be easily recognised by a potential counterfeiter.

For completeness, the applicant would like to mention the unpublished European patent application with filing number 14 169 922.3 in its name, which relates to a method of manufacturing a surface-modified material, the unpublished European patent application with filing number 15 159 107.0 in its name, which relates to a method of creating a hidden pattern, and the unpublished European patent application with filing number 15 159 109.6 in its name, which relates to an inkjet printing method.

In view of the foregoing, there remains a need in the art for paper markings, which cannot be easily reproduced, and are not detectable under ambient conditions.

Accordingly, it is an object of the present invention to provide a method for marking a substrate, which is not easily recognisable to a potential counterfeiter. It is also desirable that the method is easy to implement in existing print facilities. It is also desirable that the method is suitable for both small and large production volume. Furthermore, it is desirable that the method can be used for a great variety of substrates, and does not affect the properties of the substrates in a negative way.

It is also an object of the present invention to provide a substrate with an identifying image or pattern, which can be reliably detected with standard measurement instruments. Moreover, it is also desirable that the identifying image or pattern can be equipped with further functionalities making it machine readable and is combinable with prior art security elements.

The foregoing and other objects are solved by the subject-matter as defined herein in the independent claims.

According to one aspect of the present invention, a method of manufacturing a substrate with an embedded, UV-visible pattern, is provided, the method comprising the following steps:

a) providing an uncoated substrate comprising at least one optical brightener and optionally a filler, wherein the filler comprises 0 to 60 wt.-% of a salifiable alkaline or alkaline earth compound, based on the total weight of the substrate, b) providing a liquid treatment composition comprising at least one acid, and c) applying the liquid treatment composition onto at least one region of the substrate in form of a preselected pattern to form an embedded, UV-visible pattern.

According to a further aspect of the present invention, a substrate comprising an embedded, UV-visible pattern, obtainable by a method according to the present invention is provided.

According to still a further aspect of the present invention, a product comprising a substrate according to the present invention is provided, wherein the product is a branded product, a security document, a non-secure document, or a decorative product, preferably the product is a perfume, a drug, a tobacco product, an alcoholic drug, a bottle, a garment, a packaging, a container, a sporting good, a toy, a game, a mobile phone, a compact disc (CD), a digital video disc (DVD), a blue ray disc, a machine, a tool, a car part, a sticker, a label, a tag, a poster, a passport, a driving licence, a bank card, a credit card, a bond, a ticket, a postage or tax stamp, a banknote, a certificate, a brand authentication tag, a business card, a greeting card, a voucher, a tax banderol, or a wall paper.

According to still another aspect of the present invention, use of a substrate according to the present invention in security applications, in overt security elements, in covert security elements, in brand protection, in microlettering, in micro imaging, in decorative applications, in artistic applications, in visual applications, in packaging applications, or in track and trace applications is provided.

Advantageous embodiments of the present invention are defined in the corresponding sub-claims.

According to one embodiment the filler comprises the salifiable alkaline or alkaline earth compound in an amount of at least 1 wt.-%, preferably in an amount of at least 5 wt.-%, more preferably in an amount of at least 10 wt.-%, and most preferably in an amount of at least 20 wt.-%, based on the total weight of the substrate. According to another embodiment the optical brightener is present in an amount of at least 0.001 wt.-%, preferably at least 0.1 wt.-%, more preferably at least 0.5 wt.-%, even more preferably at least 1 wt.-%, and most preferably at least 1.2 wt.-%, based on the total weight of the substrate.

According to one embodiment the optical brightener is selected from the group consisting of stilbene derivates, pyrazolin derivates, cumarin derivates, benzoxazol derivates, naphthalimide derivates, pyrene derivates, and mixtures thereof, preferably the optical brightener is selected from the group consisting of derivatives of diaminostilbenedisulfonic acid, derivatives of diaminostilbenetetrasulfonic acid, derivatives of diaminostilbenehexasulfonic acid, 4,4'-diamino-2,2'-stilbenedisulfonic acid, 4 4'-bis(benzoxazolyl)-cis-stilbene, 2 5-bis(benzoxazol-2-yl)thiophene, 5-[(4-anilino-6-methoxy-1,3,5-triazin-2-yl)amino]-2-[(E)-2-[4-[(4-anilino-6-methoxy-1,3,5-triazin-2-yl)amino]-2-sulfonatophenyl]ethenyl]benzenesulfonate (leucophor PC), and mixtures thereof. According to another embodiment the substrate is selected from the group consisting of paper, cardboard, containerboard, or plastic, preferably the substrate is paper, cardboard, or containerboard, and most preferably the substrate is paper.

According to one embodiment the salifiable alkaline or alkaline earth compound is an alkaline or alkaline earth oxide, an alkaline or alkaline earth hydroxide, an alkaline or alkaline earth alkoxide, an alkaline or alkaline earth methylcarbonate, an alkaline or alkaline earth hydroxycarbonate, an alkaline or alkaline earth bicarbonate, an alkaline or alkaline earth carbonate, or a mixtures thereof, preferably the salifiable alkaline or alkaline earth compound is an alkaline or alkaline earth carbonate being preferably selected from lithium carbonate, sodium carbonate, potassium carbonate, magnesium carbonate, calcium magnesium carbonate, calcium carbonate, or mixtures thereof, more preferably the salifiable alkaline or alkaline earth compound is calcium carbonate, even more preferably the salifiable alkaline or alkaline earth compound is a ground calcium carbonate, a precipitated calcium carbonate and/or a surface-treated calcium carbonate, and most preferably the salifiable alkaline or alkaline earth compound is a precipitated calcium carbonate.

According to one embodiment the salifiable alkaline or alkaline earth compound is in form of particles having a weight median particle size $d_{50}$ from 15 nm to 200 μm, preferably from 20 nm to 100 μm, more preferably from 50 nm to 50 μm, and most preferably from 100 nm to 10 μm. According to another embodiment the at least one acid is selected from the group consisting of hydrochloric acid, sulphuric acid, sulphurous acid, phosphoric acid, citric acid, oxalic acid, acetic acid, formic acid, sulphamic acid, tartaric acid, phytic acid, boric acid, succinic acid, suberic acid, benzoic acid, adipic acid, pimelic acid, azelaic acid, sebaic acid, isocitric acid, aconitic acid, propane-1,2,3-tricarboxylic acid, trimesic acid, glycolic acid, lactic acid, mandelic acid, acidic organosulfur compounds, acidic organophosphorus compounds, $HSO_4$, $H_2PO_4^-$ or $HPO_4^{2-}$, being at least partially neutralized by a corresponding cation selected from $Li^+$, $Na^+$, $K^+$, $Mg^{2+}$ or $Ca^{2+}$, and mixtures thereof, preferably the at least one acid is selected from the group consisting of hydrochloric acid, sulphuric acid, sulphurous acid, phosphoric acid, oxalic acid, boric acid, suberic acid, succinic acid, sulphamic acid, tartaric acid, and mixtures thereof, more preferably the at least one acid is selected from the group consisting of sulphuric acid, phosphoric acid, boric acid, suberic acid, sulphamic acid, tartaric acid, and mixtures thereof, and most preferably the at least one acid is phosphoric acid and/or sulphuric acid.

According to one embodiment the liquid treatment composition further comprises a fluorescent dye, a phosphorescent dye, an ultraviolet absorbing dye, a near infrared absorbing dye, a thermochromic dye, a halochromic dye, metal ions, transition metal ions, lanthanides, actinides, magnetic particles, quantum dots, or a mixture thereof. According to another embodiment the liquid treatment composition comprises the acid in an amount from 0.1 to 100 wt.-%, based on the total weight of the liquid treatment composition, preferably in an amount from 1 to 80 wt.-%, more preferably in an amount from 3 to 60 wt.-%, and most preferably in an amount from 10 to 50 wt.-%.

According to one embodiment the preselected pattern is a continuous layer, a pattern, a pattern of repetitive elements and/or a repetitive combination(s) of elements, preferably the preselected pattern is a one-dimensional bar code, a two-dimensional bar code, a three-dimensional bar code, a QR-code, a dot matrix code, a security mark, a number, a letter, an alphanumeric symbol, a logo, an image, a shape, a signature, a design, or a combination thereof. According to another embodiment the liquid treatment composition is applied by spray coating, inkjet printing, offset printing, flexographic printing, screen printing, plotting, contact stamping, rotogravure printing, spin coating, reverse (counter-rotating) gravure coating, slot coating, curtain coating, slide bed coating, film press, metered film press, blade coating, brush coating, stamping and/or a pencil, preferably by inkjet printing or spray coating, and most preferably by inkjet printing. According to still another embodiment the method further comprises a step d) of applying a protective layer above the embedded, UV-visible pattern, preferably the protective layer is an overprint and is applied by printing or the protective layer is a laminate and is applied by laminating.

It should be understood that for the purpose of the present invention, the following terms have the following meaning.

For the purpose of the present invention, an "acid" is defined as Brønsted-Lowry acid, that is to say, it is an $H_3O^+$ ion provider. An "acidic salt" is defined as an $H_3O^+$ ion-provider, e.g., a hydrogen-containing salt, which is partially neutralised by an electropositive element. A "salt" is defined as an electrically neutral ionic compound formed from anions and cations. A "partially crystalline salt" is defined as a salt that, on XRD analysis, presents an essentially discrete diffraction pattern. In accordance with the present invention, $pK_a$, is the symbol representing the acid dissociation constant associated with a given ionisable hydrogen in a given acid, and is indicative of the natural degree of dissociation of this hydrogen from this acid at equilibrium in water at a given temperature. Such $pK_a$ values may be found in reference textbooks such as Harris, D. C. "Quantitative Chemical Analysis: 3rd Edition", 1991, W.H. Freeman & Co. (USA), ISBN 0-7167-2170-8.

The term "basis weight" as used in the present invention is determined according to DIN EN ISO 536:1996, and is defined as the weight in $g/m^2$.

For the purpose of the present invention, the term "coating layer" refers to a layer, covering, film, skin etc., formed, created, prepared etc., from a coating formulation which remains predominantly on one side of the substrate. The coating layer can be in direct contact with the surface of the substrate or, in case the substrate comprises one or more precoating layers and/or barrier layers, can be in direct contact with the top precoating layer or barrier layer, respectively.

For the purpose of the present invention, a "laminate" refers to a sheet of material, which can be applied over a substrate and bonded to the substrate, thereby forming a laminated substrate.

The term "liquid treatment composition" as used herein, refers to a composition in liquid from, which comprises at least one acid, and can be applied onto at least one region of the substrate of the present invention.

For the purpose of the present invention, the term "visible" means that an object fulfils the Rayleigh criteria of having a resolution of $\geq\lambda/2$, and thus, can be recognized at a wave length $\lambda$ using a suitable detection mean such as the human eye, optical microscope, scanning electron microscope, or UV-, IR-, X-ray-, or microwave detectors. The term "invisible" means that an object cannot be recognized under the conditions defined above. According to one embodiment, the term "visible" means that an object can be recognized by the un-aided or naked human eye, preferably under ambient light, and the term "invisible" means that an object cannot be recognized by the un-aided or naked human eye, preferably under ambient light.

For the purpose of the present invention, the term "optical brightener" refers to a chemical compound that absorbs light in the ultraviolet and violet region, typically between 340 and 370 nm, of the electromagnetic spectrum, and re-emits light in the blue region, typically between 420 and 470 nm, thereby causing a whiting effect of a substrate, in which it is incorporated.

"Ground calcium carbonate" (GCC) in the meaning of the present invention is a calcium carbonate obtained from natural sources, such as limestone, marble, or chalk, and processed through a wet and/or dry treatment such as grinding, screening and/or fractionating, for example, by a cyclone or classifier.

"Modified calcium carbonate" (MCC) in the meaning of the present invention may feature a natural ground or precipitated calcium carbonate with an internal structure modification or a surface-reaction product, i.e. "surface-reacted calcium carbonate". A "surface-reacted calcium carbonate" is a material comprising calcium carbonate and water-insoluble, preferably at least partially crystalline, calcium salts of anions of acids on the surface. Preferably, the insoluble calcium salt extends from the surface of at least a part of the calcium carbonate. The calcium ions forming said at least partially crystalline calcium salt of said anion originate largely from the starting calcium carbonate material. MCCs are described, for example, in US 2012/0031576 A1, WO 2009/074492 A1, EP 2 264 109 A1, WO 00/39222 A1, or EP 2 264 108 A1.

"Precipitated calcium carbonate" (PCC) in the meaning of the present invention is a synthesised material, obtained by precipitation following reaction of carbon dioxide and lime in an aqueous, semi-dry or humid environment or by precipitation of a calcium and carbonate ion source in water. PCC may be in the vateritic, calcitic or aragonitic crystal form. PCCs are described, for example, in EP 2 447 213 A1, EP 2 524 898 A1, EP 2 371 766 A1, EP 1 712 597 A1, EP 1 712 523 A1, or WO 2013/142473 A1.

Throughout the present document, the "particle size" of a salifiable alkaline or alkaline earth compound is described by its distribution of particle sizes. The value $d_x$ represents the diameter relative to which x % by weight of the particles have diameters less than $d_x$. This means that the $d_{20}$ value is the particle size at which 20 wt.-% of all particles are smaller, and the $d_{75}$ value is the particle size at which 75 wt.-% of all particles are smaller. The $d_{50}$ value is thus the weight median particle size, i.e. 50 wt.-% of all grains are bigger and the remaining 50 wt.-% are smaller than this particle size. For the purpose of the present invention the particle size is specified as weight median particle size $d_{50}$ unless indicated otherwise. For determining the weight median particle size $d_{50}$ value a Sedigraph can be used. The method and the instrument are known to the skilled person and are commonly used to determine grain size of fillers and pigments. The samples are dispersed using a high speed stirrer and ultrasonics.

A "specific surface area (SSA)" of a salifiable alkaline or alkaline earth compound in the meaning of the present invention is defined as the surface area of the compound divided by its mass. As used herein, the specific surface area is measured by nitrogen gas adsorption using the BET isotherm (ISO 9277:2010) and is specified in $m^2/g$.

For the purpose of the present invention, a "rheology modifier" is an additive that changes the rheological behaviour of a slurry or a liquid coating composition to match the required specification for the coating method employed.

A "salifiable" compound in the meaning of the present invention is defined as a compound that is capable of reacting with an acid to form a salt. Examples of salifiable compounds are alkaline or alkaline earth oxides, hydroxides, alkoxides, methylcarbonates, hydroxycarbonates, bicarbonates, or carbonates.

For the purpose of the present invention, the term "surface-modified region" refers to a distinct spatial area, in which the salifiable alkaline or alkaline earth compound of the external surface has been at least partially converted into an acid salt as a result of the application of the liquid treatment composition comprising at least one acid. Accordingly, a "surface-modified region" in the meaning of the present invention comprises at least one acid salt of the salifiable alkaline or alkaline earth compound of the external surface and the at least one acid comprised in the liquid treatment composition. The surface-modified region will have a different chemical composition and crystal structure compared to the original material.

In the meaning of the present invention, a "surface-treated calcium carbonate" is a ground, precipitated or modified calcium carbonate comprising a treatment or coating layer, e.g. a layer of fatty acids, surfactants, siloxanes, or polymers.

In the present context, the term "substrate" is to be understood as any material, which is suitable for printing, coating or painting on, such as paper, cardboard, containerboard, or plastic. The mentioned examples are, however, not of limitative character.

For the purpose of the present invention, the "thickness" and "layer weight" of a layer refers to the thickness and layer weight, respectively, of the layer after the applied coating composition has been dried.

For the purpose of the present invention, the term "viscosity" or "Brookfield viscosity" refers to Brookfield viscosity. The Brookfield viscosity is for this purpose measured by a Brookfield DV-II+ Pro viscometer at 25° C.±1° C. at 100 rpm using an appropriate spindle of the Brookfield RV-spindle set and is specified in mPa·s. Based on his technical knowledge, the skilled person will select a spindle from the Brookfield RV-spindle set which is suitable for the viscosity range to be measured. For example, for a viscosity range between 200 and 800 mPa·s the spindle number 3 may be used, for a viscosity range between 400 and 1600 mPa·s the spindle number 4 may be used, for a viscosity range between 800 and 3200 mPa·s the spindle number 5 may be used, for a viscosity range between 1000 and 2000000 mPa·s the spindle number 6 may be used, and for a viscosity range between 4000 and 8000000 mPa·s the spindle number 7 may be used.

A "suspension" or "slurry" in the meaning of the present invention comprises insoluble solids and water, and optionally further additives, and usually contains large amounts of solids and, thus, is more viscous and can be of higher density than the liquid from which it is formed.

Where the term "comprising" is used in the present description and claims, it does not exclude other elements. For the purposes of the present invention, the term "consisting of" is considered to be a preferred embodiment of the term "comprising of". If hereinafter a group is defined to comprise at least a certain number of embodiments, this is also to be understood to disclose a group, which preferably consists only of these embodiments.

Whenever the terms "including" or "having" are used, these terms are meant to be equivalent to "comprising" as defined above.

Where an indefinite or definite article is used when referring to a singular noun, e.g. "a", "an" or "the", this includes a plural of that noun unless something else is specifically stated.

Terms like "obtainable" or "definable" and "obtained" or "defined" are used interchangeably. This e.g. means that, unless the context clearly dictates otherwise, the term "obtained" does not mean to indicate that e.g. an embodiment must be obtained by e.g. the sequence of steps following the term "obtained" even though such a limited understanding is always included by the terms "obtained" or "defined" as a preferred embodiment.

According to the present invention a method of manufacturing a substrate with an embedded, UV-visible pattern is provided. The method comprising the steps of (a) providing an uncoated substrate comprising at least one optical brightener and optionally a filler, wherein the filler comprises 0 to 60 wt.-% of a salifiable alkaline or alkaline earth compound, based on the total weight of the substrate, (b) providing a liquid treatment composition comprising at least one acid, and (c) applying the liquid treatment composition onto at least one region of the substrate in form of a preselected pattern to form an embedded, UV-visible pattern.

In the following the details and preferred embodiments of the inventive method will be set out in more details. It is to be understood that these technical details and embodiments also apply to the inventive substrate and the inventive use thereof as well as to products containing the same.

Method Step a)

According to step a) of the method of the present invention, an uncoated substrate is provided.

The substrate is uncoated, i.e. it does not contain a coating layer, and may be opaque, translucent, or transparent.

According to one embodiment, the substrate is selected from the group comprising paper, cardboard, containerboard, plastic, or composites thereof. According to a preferred embodiment, the substrate is selected from the group comprising paper, cardboard, or containerboard, and more preferably the substrate is paper.

According to one embodiment of the present invention, the substrate is paper, cardboard, or containerboard. Cardboard may comprise carton board or boxboard, corrugated cardboard, or non-packaging cardboard such as chromoboard, or drawing cardboard. Containerboard may encompass linerboard and/or a corrugating medium. Both linerboard and a corrugating medium are used to produce corrugated board. The paper, cardboard, or containerboard substrate can have a basis weight from 10 to 1000 g/m$^2$, from 20 to 800 g/m$^2$, from 30 to 700 g/m$^2$, or from 50 to 600 g/m$^2$. According to one embodiment, the substrate is paper, preferably having a basis weight from 10 to 400 g/m$^2$, 20 to 300 g/m$^2$, 30 to 200 g/m$^2$, 40 to 100 g/m$^2$, 50 to 90 g/m$^2$, 60 to 80 g/m$^2$, or about 70 g/m$^2$.

According to another embodiment, the substrate is a plastic substrate. Suitable plastic materials are, for example, polyethylene, polypropylene, polyvinylchloride, polyesters, polycarbonate resins, or fluorine-containing resins, preferably polypropylene. Examples for suitable polyesters are poly(ethylene terephthalate), poly(ethylene naphthalate) or poly(ester diacetate). An example for a fluorine-containing resins is poly(tetrafluoro ethylene). The plastic substrate may be filled by a mineral filler, an organic pigment, an inorganic pigment, or mixtures thereof.

The substrate may consist of only one layer of the above-mentioned materials or may comprise a layer structure having several sublayers of the same material or different materials. According to one embodiment, the substrate is structured by one layer. According to another embodiment the substrate is structured by at least two sublayers, preferably three, five, or seven sublayers, wherein the sublayers can have a flat or non-flat structure, e.g. a corrugated structure. Preferably the sublayers of the substrate are made from paper, cardboard, containerboard and/or plastic. "Sublayers" in the meaning of the present invention are not coating layers.

According to the present invention, the uncoated substrate comprises an optical brightener.

According to one embodiment, the optical brightener is present in an amount of at least 0.001 wt.-%, preferably at least 0.1 wt.-%, more preferably at least 0.5 wt.-%, even more preferably at least 1 wt.-%, and most preferably at least 1.2 wt.-%, based on the total weight of the substrate. According to another embodiment, the optical brightener is present in an amount from 0.001 to 15 wt.-%, preferably from 0.1 to 10 wt.-%, more preferably from 0.5 to 8 wt.-%, even more preferably from 1 to 6 wt.-%, and most preferably from 1.2 to 4 wt.-%, based on the total weight of the substrate.

For the purpose of the present invention, the term "optical brightener" refers to a chemical compound that absorbs light in the ultraviolet and violet region, typically between 340 and 370 nm, of the electromagnetic spectrum, and re-emits light in the blue region, typically between 420 and 470 nm, thereby causing a whiting effect of a substrate, in which it is incorporated.

The most commonly used class of optical brightener compounds are derivates of stilbenes such as 4,4'-diamino-2,2'-stilbenedisulfonic acid. These optical brighteners absorb ultraviolet light within the range of 350 to 360 nm, and re-emit blue light at 400 to 500 nm with a maximum wavelength at 430 nm. The sulfonic acid groups contribute to the water solubility of the optical brightener, and thus, the affinity of the optical brightener for cellulose can be manipulated by changing the number of sulfonic acid groups. A disulfonic or divalent optical brightener is constituted of two sulfonic acid groups and is particularly suitable for hydrophobic fibers such as nylon, silk, and wool application at acidic pH. A tetrasulfonic or tetravalent optical brightener is constituted of four sulfonic groups, has a good water-solubility, and is particularly suitable for cellulosic fiber and paper application at neutral or alkaline pH. A hexasulfonic or hexavalent optical brightener is constituted of six sulfonic groups and has excellent solubility for surface coating application like photographic paper. Others classes of optical brighteners include derivatives of pyrazolin, cumarin, benzoxazol, naphthalimide, and pyrene.

According to one embodiment of the present invention, the optical brightener is selected from the group consisting of stilbene derivates, pyrazolin derivates, cumarin derivates, benzoxazol derivates, naphthalimide derivates, pyrene derivates, and mixtures thereof, preferably the optical brightener is selected from the group consisting of derivatives of diaminostilbenedisulfonic acid, derivatives of diaminostilbenetetrasulfonic acid, derivatives of diaminostilbenehexasulfonic acid, 4,4'-diamino-2,2'-stilbenedisulfonic acid, 4 4'-bis(benzoxazolyl)-cis-stilbene, 2 5-bis(benzoxazol-2-yl) thiophene, 5-[(4-anilino-6-methoxy-1,3,5-triazin-2-yl) amino]-2-[(E)-2-[4-[(4-anilino-6-methoxy-1,3,5-triazin-2-yl)amino]-2-sulfonatophenyl]ethenyl]benzenesulfonate (leucophor PC), and mixtures thereof.

According to the present invention, the substrate may optionally comprise a filler, wherein the filler comprises 0 to 60 wt.-% of a salifiable alkaline or alkaline earth compound, based on the total weight of the substrate. According to one embodiment, the substrate comprises a filler, wherein the filler comprises 0.001 to 60 wt.-% of a salifiable alkaline or alkaline earth compound, based on the total weight of the substrate.

The substrate may comprise the filler in an amount from 1 to 99 wt.-%, based on the total weight of the substrate, preferably from 1 to 90 wt.-%, more preferably from 5 to 70 wt.-%, even more preferably from 10 to 50 wt.-%, and most preferably from 15 to 40 wt.-%. According to one embodiment the amount of the filler in the substrate ranges from 20 to 30 wt.-%, based on the total weight of the substrate.

According to one embodiment, the filler comprises the salifiable alkaline or alkaline earth compound in an amount of at least 1 wt.-%, preferably in an amount of at least 5 wt.-%, more preferably in an amount of at least 10 wt.-%, and most preferably in an amount of at least 20 wt.-%, based on the total weight of the substrate. According to another embodiment, the filler comprises the salifiable alkaline or alkaline earth compound in an amount from 1 to 60 wt.-%, preferably in an amount from 5 to 50 wt.-%, more preferably in an amount from 10 to 40 wt.-%, and most preferably in an amount from 15 to 35 wt.-%, based on the total weight of the substrate. According to one embodiment the filler comprises the salifiable alkaline or alkaline earth compound in an amount from 20 to 30 wt.-%, based on the total weight of the substrate.

According to one embodiment, the salifiable alkaline or alkaline earth compound is an alkaline or alkaline earth oxide, an alkaline or alkaline earth hydroxide, an alkaline or alkaline earth alkoxide, an alkaline or alkaline earth methylcarbonate, an alkaline or alkaline earth hydroxycarbonate, an alkaline or alkaline earth bicarbonate, an alkaline or alkaline earth carbonate, or a mixture thereof. Preferably, the salifiable alkaline or alkaline earth compound is an alkaline or alkaline earth carbonate.

The alkaline or alkaline earth carbonate may be selected from lithium carbonate, sodium carbonate, potassium carbonate, magnesium carbonate, calcium magnesium carbonate, calcium carbonate, or mixtures thereof. According to one embodiment, the alkaline or alkaline earth carbonate is calcium carbonate, more preferably the alkaline or alkaline earth carbonate is a ground calcium carbonate, a precipitated calcium carbonate, a modified calcium carbonate and/or a surface-treated calcium carbonate, and most preferably a ground calcium carbonate, a precipitated calcium carbonate and/or a surface-treated calcium carbonate. According to a preferred embodiment, the calcium carbonate is ground calcium carbonate.

Ground (or natural) calcium carbonate (GCC) is understood to be manufactured from a naturally occurring form of calcium carbonate, mined from sedimentary rocks such as limestone or chalk, or from metamorphic marble rocks, eggshells or seashells. Calcium carbonate is known to exist as three types of crystal polymorphs: calcite, aragonite and vaterite. Calcite, the most common crystal polymorph, is considered to be the most stable crystal form of calcium carbonate. Less common is aragonite, which has a discrete or clustered needle orthorhombic crystal structure. Vaterite is the rarest calcium carbonate polymorph and is generally unstable. Ground calcium carbonate is almost exclusively of the calcitic polymorph, which is said to be trigonal-rhombohedral and represents the most stable of the calcium carbonate polymorphs. The term "source" of the calcium carbonate in the meaning of the present application refers to the naturally occurring mineral material from which the calcium carbonate is obtained. The source of the calcium carbonate may comprise further naturally occurring components such as magnesium carbonate, alumino silicate etc.

According to one embodiment of the present invention the GCC is obtained by dry grinding. According to another embodiment of the present invention the GCC is obtained by wet grinding and optionally subsequent drying.

In general, the grinding step can be carried out with any conventional grinding device, for example, under conditions such that comminution predominantly results from impacts with a secondary body, i.e. in one or more of: a ball mill, a rod mill, a vibrating mill, a roll crusher, a centrifugal impact mill, a vertical bead mill, an attrition mill, a pin mill, a hammer mill, a pulveriser, a shredder, a de-clumper, a knife cutter, or other such equipment known to the skilled man. In case the calcium carbonate comprising mineral material comprises a wet ground calcium carbonate comprising mineral material, the grinding step may be performed under conditions such that autogenous grinding takes place and/or by horizontal ball milling, and/or other such processes known to the skilled man. The wet processed ground calcium carbonate comprising mineral material thus obtained may be washed and dewatered by well-known processes, e.g. by flocculation, centrifugation, filtration or forced evaporation prior to drying. The subsequent step of drying may be carried out in a single step such as spray drying, or in at least two steps. It is also common that such a mineral material undergoes a beneficiation step (such as a flotation, bleaching or magnetic separation step) to remove impurities.

According to one embodiment of the present invention, the ground calcium carbonate is selected from the group consisting of marble, chalk, dolomite, limestone and mixtures thereof.

According to one embodiment of the present invention, the calcium carbonate comprises one type of ground calcium carbonate. According to another embodiment of the present invention, the calcium carbonate comprises a mixture of two or more types of ground calcium carbonates selected from different sources.

"Precipitated calcium carbonate" (PCC) in the meaning of the present invention is a synthesized material, generally obtained by precipitation following reaction of carbon dioxide and lime in an aqueous environment or by precipitation of a calcium and carbonate ion source in water or by precipitation of calcium and carbonate ions, for example $CaCl_2$ and $Na_2CO_3$, out of solution. Further possible ways of producing PCC are the lime soda process, or the Solvay process in which PCC is a by-product of ammonia production. Precipitated calcium carbonate exists in three primary crystalline forms: calcite, aragonite and vaterite, and there are many different polymorphs (crystal habits) for each of these crystalline forms. Calcite has a trigonal structure with typical crystal habits such as scalenohedral (S-PCC), rhombohedral (R-PCC), hexagonal prismatic, pinacoidal, colloidal (C-PCC), cubic, and prismatic (P-PCC). Aragonite is an orthorhombic structure with typical crystal habits of twinned hexagonal prismatic crystals, as well as a diverse assortment of thin elongated prismatic, curved bladed, steep pyramidal, chisel shaped crystals, branching tree, and coral or worm-like form. Vaterite belongs to the hexagonal crystal system. The obtained PCC slurry can be mechanically dewatered and dried.

According to one embodiment of the present invention, the calcium carbonate comprises one precipitated calcium carbonate. According to another embodiment of the present invention, the calcium carbonate comprises a mixture of two or more precipitated calcium carbonates selected from different crystalline forms and different polymorphs of precipitated calcium carbonate. For example, the at least one precipitated calcium carbonate may comprise one PCC selected from S-PCC and one PCC selected from R-PCC.

According to another embodiment, the salifiable alkaline or alkaline earth compound may be surface-treated material, for example, a surface-treated calcium carbonate.

A surface-treated calcium carbonate may feature a ground calcium carbonate, a modified calcium carbonate, or a precipitated calcium carbonate comprising a treatment or coating layer on its surface. For example, the calcium carbonate may be treated or coated with a hydrophobising agent such as, e.g., aliphatic carboxylic acids, salts or esters thereof, or a siloxane. Suitable aliphatic acids are, for example, $C_5$ to $C_{28}$ fatty acids such as stearic acid, palmitic acid, myristic acid, lauric acid, or a mixture thereof. The calcium carbonate may also be treated or coated to become cationic or anionic with, for example, a polyacrylate or polydiallyldimethyl-ammonium chloride (polyDADMAC). Surface-treated calcium carbonates are, for example, described in EP 2 159 258 A1 or WO 2005/121257 A1.

According to one embodiment, the surface-treated calcium carbonate comprises a treatment layer or surface coating obtained from the treatment with fatty acids, their salts, their esters, or combinations thereof, preferably from the treatment with aliphatic $C_5$ to $C_{28}$ fatty acids, their salts, their esters, or combinations thereof, and more preferably from the treatment with ammonium stearate, calcium stearate, stearic acid, palmitic acid, myristic acid, lauric acid, or mixtures thereof. According to an exemplary embodiment, the alkaline or alkaline earth carbonate is a surface-treated calcium carbonate, preferably a ground calcium carbonate comprising a treatment layer or surface coating obtained from the treatment with a fatty acid, preferably stearic acid.

In one embodiment, the hydrophobising agent is an aliphatic carboxylic acid having a total amount of carbon atoms from C4 to C24 and/or reaction products thereof. Accordingly, at least a part of the accessible surface area of the calcium carbonate particles is covered by a treatment layer comprising an aliphatic carboxylic acid having a total amount of carbon atoms from C4 to C24 and/or reaction products thereof. The term "accessible" surface area of a material refers to the part of the material surface which is in contact with a liquid phase of an aqueous solution, suspension, dispersion or reactive molecules such as a hydrophobising agent.

The term "reaction products" of the aliphatic carboxylic acid in the meaning of the present invention refers to products obtained by contacting the at least one calcium carbonate with the at least one aliphatic carboxylic acid. Said reaction products are formed between at least a part of the applied at least one aliphatic carboxylic acid and reactive molecules located at the surface of the calcium carbonate particles.

The aliphatic carboxylic acid in the meaning of the present invention may be selected from one or more straight chain, branched chain, saturated, unsaturated and/or alicyclic carboxylic acids. Preferably, the aliphatic carboxylic acid is a monocarboxylic acid, i.e. the aliphatic carboxylic acid is characterized in that a single carboxyl group is present. Said carboxyl group is placed at the end of the carbon skeleton.

In one embodiment of the present invention, the aliphatic carboxylic acid is selected from saturated unbranched carboxylic acids, that is to say the aliphatic carboxylic acid is preferably selected from the group of carboxylic acids consisting of pentanoic acid, hexanoic acid, heptanoic acid, octanoic acid, nonanoic acid, decanoic acid, undecanoic acid, lauric acid, tridecanoic acid, myristic acid, pentadecanoic acid, palmitic acid, heptadecanoic acid, stearic acid, nonadecanoic acid, arachidic acid, heneicosylic acid, behenic acid, tricosylic acid, lignoceric acid and mixtures thereof.

In another embodiment of the present invention, the aliphatic carboxylic acid is selected from the group consisting of octanoic acid, decanoic acid, lauric acid, myristic acid, palmitic acid, stearic acid, arachidic acid and mixtures thereof. Preferably, the aliphatic carboxylic acid is selected from the group consisting of myristic acid, palmitic acid, stearic acid and mixtures thereof. For example, the aliphatic carboxylic acid is stearic acid.

Additionally or alternatively, the hydrophobising agent can be at least one mono-substituted succinic anhydride consisting of succinic anhydride mono-substituted with a group selected from a linear, branched, aliphatic and cyclic group having a total amount of carbon atoms from C2 to C30 in the substituent. Accordingly, at least a part of the accessible surface area of the calcium carbonate particles is covered by a treatment layer comprising at least one mono-substituted succinic anhydride consisting of succinic anhydride mono-substituted with a group selected from a linear, branched, aliphatic and cyclic group having a total amount of carbon atoms from C2 to C30 in the substituent and/or reaction products thereof. It will be appreciated by the skilled person that in case the at least one mono-substituted succinic anhydride consists of succinic anhydride mono-substituted with a branched and/or cyclic group, said group will have a total amount of carbon atoms from C3 to C30 in the substituent.

The term "reaction products" of the mono-substituted succinic anhydride in the meaning of the present invention refers to products obtained by contacting the calcium carbonate with the at least one mono-substituted succinic anhydride. Said reaction products are formed between at least a part of the applied at least one mono-substituted succinic anhydride and reactive molecules located at the surface of the calcium carbonate particles.

For example, the at least one mono-substituted succinic anhydride consists of succinic anhydride mono-substituted with one group being a linear alkyl group having a total amount of carbon atoms from C2 to C30, preferably from C3 to C20 and most preferably from C4 to C18 in the substituent or a branched alkyl group having a total amount of carbon atoms from C3 to C30, preferably from C3 to C20 and most preferably from C4 to C18 in the substituent.

For example, the at least one mono-substituted succinic anhydride consists of succinic anhydride mono-substituted with one group being a linear alkyl group having a total amount of carbon atoms from C2 to C30, preferably from C3 to C20 and most preferably from C4 to C18 in the substituent. Additionally or alternatively, the at least one mono-substituted succinic anhydride consists of succinic anhydride mono-substituted with one group being a branched alkyl group having a total amount of carbon atoms from C3 to C30, preferably from C3 to C20 and most preferably from C4 to C18 in the substituent.

The term "alkyl" in the meaning of the present invention refers to a linear or branched, saturated organic compound composed of carbon and hydrogen. In other words, "alkyl mono-substituted succinic anhydrides" are composed of linear or branched, saturated hydrocarbon chains containing a pendant succinic anhydride group.

In one embodiment of the present invention, the at least one mono-substituted succinic anhydride is at least one linear or branched alkyl mono-substituted succinic anhydride. For example, the at least one alkyl mono-substituted succinic anhydride is selected from the group comprising ethylsuccinic anhydride, propylsuccinic anhydride, butylsuccinic anhydride, triisobutyl succinic anhydride, pentylsuccinic anhydride, hexylsuccinic anhydride, heptylsuccinic anhydride, octylsuccinic anhydride, nonylsuccinic anhydride, decyl succinic anhydride, dodecyl succinic anhydride, hexadecanyl succinic anhydride, octadecanyl succinic anhydride, and mixtures thereof.

It is appreciated that e.g. the term "butylsuccinic anhydride" comprises linear and branched butylsuccinic anhydride(s). One specific example of linear butylsuccinic anhydride(s) is n-butylsuccinic anhydride. Specific examples of branched butylsuccinic anhydride(s) are iso-butylsuccinic anhydride, sec-butylsuccinic anhydride and/or tert-butylsuccinic anhydride.

Furthermore, it is appreciated that e.g. the term "hexadecanyl succinic anhydride" comprises linear and branched hexadecanyl succinic anhydride(s). One specific example of linear hexadecanyl succinic anhydride(s) is n-hexadecanyl succinic anhydride. Specific examples of branched hexadecanyl succinic anhydride(s) are 14-methylpentadecanyl succinic anhydride, 13-methylpentadecanyl succinic anhydride, 12-methylpentadecanyl succinic anhydride, 11-methylpentadecanyl succinic anhydride, 10-methylpentadecanyl succinic anhydride, 9-methylpentadecanyl succinic anhydride, 8-methylpentadecanyl succinic anhydride, 7-methylpentadecanyl succinic anhydride, 6-methylpentadecanyl succinic anhydride, 5-methylpentadecanyl succinic anhydride, 4-methylpentadecanyl succinic anhydride, 3-methylpentadecanyl succinic anhydride, 2-methylpentadecanyl succinic anhydride, 1-methylpentadecanyl succinic anhydride, 13-ethylbutadecanyl succinic anhydride, 12-ethylbutadecanyl succinic anhydride, 11-ethylbutadecanyl succinic anhydride, 10-ethylbutadecanyl succinic anhydride, 9-ethylbutadecanyl succinic anhydride, 8-ethylbutadecanyl succinic anhydride, 7-ethylbutadecanyl succinic anhydride, 6-ethylbutadecanyl succinic anhydride, 5-ethylbutadecanyl succinic anhydride, 4-ethylbutadecanyl succinic anhydride, 3-ethylbutadecanyl succinic anhydride, 2-ethylbutadecanyl succinic anhydride, 1-ethylbutadecanyl succinic anhydride, 2-butyldodecanyl succinic anhydride, 1-hexyldecanyl succinic anhydride, 1-hexyl-2-decanyl succinic anhydride, 2-hexyldecanyl succinic anhydride, 6,12-dimethylbutadecanyl succinic anhydride, 2,2-diethyldodecanyl succinic anhydride, 4,8,12-trimethyltridecanyl succinic anhydride, 2,2,4,6,8-pentamethylundecanyl succinic anhydride, 2-ethyl-4-methyl-2-(2-methylpentyl)-heptyl succinic anhydride and/or 2-ethyl-4,6-dimethyl-2-propylnonyl succinic anhydride.

Furthermore, it is appreciated that e.g. the term "octadecanyl succinic anhydride" comprises linear and branched octadecanyl succinic anhydride(s). One specific example of linear octadecanyl succinic anhydride(s) is n-octadecanyl succinic anhydride. Specific examples of branched hexadecanyl succinic anhydride(s) are 16-methylheptadecanyl succinic anhydride, 15-methylheptadecanyl succinic anhydride, 14-methylheptadecanyl succinic anhydride, 13-methylheptadecanyl succinic anhydride, 12-methylheptadecanyl succinic anhydride, 11-methylheptadecanyl succinic anhydride, 10-methylheptadecanyl succinic anhydride, 9-methylheptadecanyl succinic anhydride, 8-methylheptadecanyl succinic anhydride, 7-methylheptadecanyl succinic anhydride, 6-methylheptadecanyl succinic anhydride, 5-methylheptadecanyl succinic anhydride, 4-methylheptadecanyl succinic anhydride, 3-methylheptadecanyl succinic anhydride, 2-methylheptadecanyl succinic anhydride, 1-methylheptadecanyl succinic anhydride, 14-ethylhexadecanyl succinic anhydride, 13-ethylhexadecanyl succinic anhydride, 12-ethylhexadecanyl succinic anhydride, 11-ethylhexadecanyl succinic anhydride, 10-ethylhexadecanyl succinic anhydride, 9-ethylhexadecanyl succinic anhydride, 8-ethylhexadecanyl succinic anhydride, 7-ethylhexadecanyl succinic anhydride, 6-ethylhexadecanyl succinic anhydride, 5-ethylhexadecanyl succinic anhydride, 4-ethylhexadecanyl succinic anhydride, 3-ethylhexadecanyl succinic anhydride, 2-ethylhexadecanyl succinic anhydride, 1-ethylhexadecanyl succinic anhydride, 2-hexyldodecanyl succinic anhydride, 2-heptylundecanyl succinic anhydride, iso-octadecanyl succinic anhydride and/or 1-octyl-2-decanyl succinic anhydride.

In one embodiment of the present invention, the at least one alkyl mono-substituted succinic anhydride is selected from the group comprising butylsuccinic anhydride, hexylsuccinic anhydride, heptylsuccinic anhydride, octylsuccinic anhydride, hexadecanyl succinic anhydride, octadecanyl succinic anhydride, and mixtures thereof.

In one embodiment of the present invention, the at least one mono-substituted succinic anhydride is one kind of alkyl mono-substituted succinic anhydride. For example, the one alkyl mono-substituted succinic anhydride is butylsuccinic anhydride. Alternatively, the one alkyl mono-substituted succinic anhydride is hexylsuccinic anhydride. Alternatively, the one alkyl mono-substituted succinic anhydride is heptylsuccinic anhydride or octylsuccinic anhydride. Alternatively, the one alkyl mono-substituted succinic anhydride is hexadecanyl succinic anhydride. For example, the one alkyl mono-substituted succinic anhydride is linear hexadecanyl succinic anhydride such as n-hexadecanyl succinic anhydride or branched hexadecanyl succinic anhydride such as 1-hexyl-2-decanyl succinic anhydride. Alternatively, the one alkyl mono-substituted succinic anhydride is octadecanyl succinic anhydride. For example, the one alkyl mono-substituted succinic anhydride is linear octadecanyl succinic anhydride such as n-octadecanyl succinic anhydride or branched octadecanyl succinic anhydride such as iso-octadecanyl succinic anhydride or 1-octyl-2-decanyl succinic anhydride.

In one embodiment of the present invention, the one alkyl mono-substituted succinic anhydride is butylsuccinic anhydride such as n-butylsuccinic anhydride.

In one embodiment of the present invention, the at least one mono-substituted succinic anhydride is a mixture of two or more kinds of alkyl mono-substituted succinic anhydrides. For example, the at least one mono-substituted succinic anhydride is a mixture of two or three kinds of alkyl mono-substituted succinic anhydrides.

In one embodiment of the present invention, the at least one mono-substituted succinic anhydride consists of succinic anhydride mono-substituted with one group being a linear alkenyl group having a total amount of carbon atoms from C2 to C30, preferably from C3 to C20 and most preferably from C4 to C18 in the substituent or a branched alkenyl group having a total amount of carbon atoms from C3 to C30, preferably from C4 to C20 and most preferably from C4 to C18 in the substituent.

The term "alkenyl" in the meaning of the present invention refers to a linear or branched, unsaturated organic compound composed of carbon and hydrogen. Said organic compound further contains at least one double bond in the substituent, preferably one double bond. In other words, "alkenyl mono-substituted succinic anhydrides" are composed of linear or branched, unsaturated hydrocarbon chains containing a pendant succinic anhydride group. It is appreciated that the term "alkenyl" in the meaning of the present invention includes the cis and trans isomers.

In one embodiment of the present invention, the at least one mono-substituted succinic anhydride is at least one linear or branched alkenyl mono-substituted succinic anhydride. For example, the at least one alkenyl mono-substituted succinic anhydride is selected from the group comprising ethenylsuccinic anhydride, propenylsuccinic anhydride, butenylsuccinic anhydride, triisobutenyl succinic anhydride, pentenylsuccinic anhydride, hexenylsuccinic anhydride, heptenylsuccinic anhydride, octenylsuccinic anhydride, nonenylsuccinic anhydride, decenyl succinic anhydride, dodecenyl succinic anhydride, hexadecenyl succinic anhydride, octadecenyl succinic anhydride, and mixtures thereof.

Accordingly, it is appreciated that e.g. the term "hexadecenyl succinic anhydride" comprises linear and branched hexadecenyl succinic anhydride(s). One specific example of linear hexadecenyl succinic anhydride(s) is n-hexadecenyl succinic anhydride such as 14-hexadecenyl succinic anhydride, 13-hexadecenyl succinic anhydride, 12-hexadecenyl succinic anhydride, 11-hexadecenyl succinic anhydride, 10-hexadecenyl succinic anhydride, 9-hexadecenyl succinic anhydride, 8-hexadecenyl succinic anhydride, 7-hexadecenyl succinic anhydride, 6-hexadecenyl succinic anhydride, 5-hexadecenyl succinic anhydride, 4-hexadecenyl succinic anhydride, 3-hexadecenyl succinic anhydride and/or 2-hexadecenyl succinic anhydride. Specific examples of branched hexadecenyl succinic anhydride(s) are 14-methyl-9-pentadecenyl succinic anhydride, 14-methyl-2-pentadecenyl succinic anhydride, 1-hexyl-2-decenyl succinic anhydride and/or iso-hexadecenyl succinic anhydride.

Furthermore, it is appreciated that e.g. the term "octadecenyl succinic anhydride" comprises linear and branched octadecenyl succinic anhydride(s). One specific example of linear octadecenyl succinic anhydride(s) is n-octadecenyl succinic anhydride such as 16-octadecenyl succinic anhydride, 15-octadecenyl succinic anhydride, 14-octadecenyl succinic anhydride, 13-octadecenyl succinic anhydride, 12-octadecenyl succinic anhydride, 11-octadecenyl succinic anhydride, 10-octadecenyl succinic anhydride, 9-octadecenyl succinic anhydride, 8-octadecenyl succinic anhydride, 7-octadecenyl succinic anhydride, 6-octadecenyl succinic anhydride, 5-octadecenyl succinic anhydride, 4-octadecenyl succinic anhydride, 3-octadecenyl succinic anhydride and/or 2-octadecenyl succinic anhydride. Specific examples of branched octadecenyl succinic anhydride(s) are 16-methyl-9-heptadecenyl succinic anhydride, 16-methyl-7-heptadecenyl succinic anhydride, 1-octyl-2-decenyl succinic anhydride and/or iso-octadecenyl succinic anhydride.

In one embodiment of the present invention, the at least one alkenyl mono-substituted succinic anhydride is selected from the group comprising hexenylsuccinic anhydride, octenylsuccinic anhydride, hexadecenyl succinic anhydride, octadecenyl succinic anhydride, and mixtures thereof.

In one embodiment of the present invention, the at least one mono-substituted succinic anhydride is one alkenyl mono-substituted succinic anhydride. For example, the one alkenyl mono-substituted succinic anhydride is hexenylsuccinic anhydride. Alternatively, the one alkenyl mono-substituted succinic anhydride is octenylsuccinic anhydride. Alternatively, the one alkenyl mono-substituted succinic anhydride is hexadecenyl succinic anhydride. For example, the one alkenyl mono-substituted succinic anhydride is linear hexadecenyl succinic anhydride such as n-hexadecenyl succinic anhydride or branched hexadecenyl succinic anhydride such as 1-hexyl-2-decenyl succinic anhydride. Alternatively, the one alkenyl mono-substituted succinic anhydride is octadecenyl succinic anhydride. For example, the one alkyl mono-substituted succinic anhydride is linear octadecenyl succinic anhydride such as n-octadecenyl succinic anhydride or branched octadecenyl succinic anhydride such iso-octadecenyl succinic anhydride, or 1-octyl-2-decenyl succinic anhydride.

In one embodiment of the present invention, the one alkenyl mono-substituted succinic anhydride is linear octadecenyl succinic anhydride such as n-octadecenyl succinic anhydride. In another embodiment of the present invention, the one alkenyl mono-substituted succinic anhydride is linear octenylsuccinic anhydride such as n-octenylsuccinic anhydride.

If the at least one mono-substituted succinic anhydride is one alkenyl mono-substituted succinic anhydride, it is appreciated that the one alkenyl mono-substituted succinic anhydride is present in an amount of ≥95 wt.-% and preferably of ≥96.5 wt.-%, based on the total weight of the at least one mono-substituted succinic anhydride.

In one embodiment of the present invention, the at least one mono-substituted succinic anhydride is a mixture of two or more kinds of alkenyl mono-substituted succinic anhydrides. For example, the at least one mono-substituted succinic anhydride is a mixture of two or three kinds of alkenyl mono-substituted succinic anhydrides.

In one embodiment of the present invention, the at least one mono-substituted succinic anhydride is a mixture of two or more kinds of alkenyl mono-substituted succinic anhydrides comprising linear hexadecenyl succinic anhydride(s) and linear octadecenyl succinic anhydride(s). Alternatively, the at least one mono-substituted succinic anhydride is a mixture of two or more kinds of alkenyl mono-substituted succinic anhydrides comprising branched hexadecenyl succinic anhydride(s) and branched octadecenyl succinic anhydride(s). For example, the one or more hexadecenyl succinic anhydride is linear hexadecenyl succinic anhydride like n-hexadecenyl succinic anhydride and/or branched hexadecenyl succinic anhydride like 1-hexyl-2-decenyl succinic anhydride. Additionally or alternatively, the one or more octadecenyl succinic anhydride is linear octadecenyl succinic anhydride like n-octadecenyl succinic anhydride and/or branched octadecenyl succinic anhydride like iso-octadecenyl succinic anhydride and/or 1-octyl-2-decenyl succinic anhydride.

It is also appreciated that the at least one mono-substituted succinic anhydride may be a mixture of at least one alkyl mono-substituted succinic anhydrides and at least one alkenyl mono-substituted succinic anhydrides.

If the at least one mono-substituted succinic anhydride is a mixture of at least one alkyl mono-substituted succinic anhydrides and at least one alkenyl mono-substituted succinic anhydrides, it is appreciated that the alkyl substituent of the of at least one alkyl mono-substituted succinic anhydrides and the alkenyl substituent of the of at least one alkenyl mono-substituted succinic anhydrides are preferably the same. For example, the at least one mono-substituted succinic anhydride is a mixture of ethylsuccinic anhydride and ethenylsuccinic anhydride. Alternatively, the at least one mono-substituted succinic anhydride is a mixture of propylsuccinic anhydride and propenylsuccinic anhydride. Alternatively, the at least one mono-substituted succinic anhydride is a mixture of butylsuccinic anhydride and butenylsuccinic anhydride. Alternatively, the at least one mono-substituted succinic anhydride is a mixture of triisobutyl succinic anhydride and triisobutenyl succinic anhydride. Alternatively, the at least one mono-substituted succinic anhydride is a mixture of pentylsuccinic anhydride and pentenylsuccinic anhydride. Alternatively, the at least one mono-substituted succinic anhydride is a mixture of hexylsuccinic anhydride and hexenylsuccinic anhydride. Alternatively, the at least one mono-substituted succinic anhydride is a mixture of heptylsuccinic anhydride and heptenylsuccinic anhydride. Alternatively, the at least one mono-substituted succinic anhydride is a mixture of octylsuccinic anhydride and octenylsuccinic anhydride. Alternatively, the at least one mono-substituted succinic anhydride is a mixture of nonylsuccinic anhydride and nonenylsuccinic anhydride. Alternatively, the at least one mono-substituted succinic anhydride is a mixture of decyl succinic anhydride and decenyl succinic anhydride. Alternatively, the at least one mono-substituted succinic anhydride is a mixture of dodecyl succinic anhydride and dodecenyl succinic anhydride. Alternatively, the at least one mono-substituted succinic anhydride is a mixture of hexadecanyl succinic anhydride and hexadecenyl succinic anhydride. For example, the at least one mono-substituted succinic anhydride is a mixture of linear hexadecanyl succinic anhydride and linear hexadecenyl succinic anhydride or a mixture of branched hexadecanyl succinic anhydride and branched hexadecenyl succinic anhydride. Alternatively, the at least one mono-substituted succinic anhydride is a mixture of octadecanyl succinic anhydride and octadecenyl succinic anhydride. For example, the at least one mono-substituted succinic anhydride is a mixture of linear octadecanyl succinic anhydride and linear octadecenyl succinic anhydride or a mixture of branched octadecanyl succinic anhydride and branched octadecenyl succinic anhydride.

In one embodiment of the present invention, the at least one mono-substituted succinic anhydride is a mixture of nonylsuccinic anhydride and nonenylsuccinic anhydride.

If the at least one mono-substituted succinic anhydride is a mixture of at least one alkyl mono-substituted succinic anhydrides and at least one alkenyl mono-substituted succinic anhydrides, the weight ratio between the at least one alkyl mono-substituted succinic anhydride and the at least one alkenyl mono-substituted succinic anhydride is between 90:10 and 10:90 (wt.-%/wt.-%). For example, the weight ratio between the at least one alkyl mono-substituted succinic anhydride and the at least one alkenyl mono-substituted succinic anhydride is between 70:30 and 30:70 (wt.-%/wt.-%) or between 60:40 and 40:60.

Additionally or alternatively, the hydrophobising agent may be a phosphoric acid ester blend. Accordingly, at least a part of the accessible surface area of the calcium carbonate particles is covered by a treatment layer comprising a phosphoric acid ester blend of one or more phosphoric acid mono-ester and/or reaction products thereof and one or more phosphoric acid di-ester and/or reaction products thereof.

The term "reaction products" of the phosphoric acid mono-ester and one or more phosphoric acid di-ester in the meaning of the present invention refers to products obtained by contacting the calcium carbonate with the at least one phosphoric acid ester blend. Said reaction products are formed between at least a part of the applied phosphoric acid ester blend and reactive molecules located at the surface of the calcium carbonate particles.

The term "phosphoric acid mono-ester" in the meaning of the present invention refers to an o-phosphoric acid molecule mono-esterified with one alcohol molecule selected from unsaturated or saturated, branched or linear, aliphatic or aromatic alcohols having a total amount of carbon atoms from C6 to C30, preferably from C8 to C22, more preferably from C8 to C20 and most preferably from C8 to C18 in the alcohol substituent.

The term "phosphoric acid di-ester" in the meaning of the present invention refers to an o-phosphoric acid molecule di-esterified with two alcohol molecules selected from the same or different, unsaturated or saturated, branched or linear, aliphatic or aromatic alcohols having a total amount of carbon atoms from C6 to C30, preferably from C8 to C22, more preferably from C8 to C20 and most preferably from C8 to C18 in the alcohol substituent.

It is appreciated that the expression "one or more" phosphoric acid mono-ester means that one or more kinds of phosphoric acid mono-ester may be present in the phosphoric acid ester blend.

Accordingly, it should be noted that the one or more phosphoric acid mono-ester may be one kind of phosphoric acid mono-ester. Alternatively, the one or more phosphoric acid mono-ester may be a mixture of two or more kinds of phosphoric acid mono-ester. For example, the one or more phosphoric acid mono-ester may be a mixture of two or three kinds of phosphoric acid mono-ester, like two kinds of phosphoric acid mono-ester.

In one embodiment of the present invention, the one or more phosphoric acid mono-ester consists of an o-phosphoric acid molecule esterified with one alcohol selected from unsaturated or saturated, branched or linear, aliphatic or aromatic alcohols having a total amount of carbon atoms from C6 to C30 in the alcohol substituent. For example, the one or more phosphoric acid mono-ester consists of an o-phosphoric acid molecule esterified with one alcohol selected from unsaturated or saturated, branched or linear, aliphatic or aromatic alcohols having a total amount of carbon atoms from C8 to C22, more preferably from C8 to C20 and most preferably from C8 to C18 in the alcohol substituent.

In one embodiment of the present invention, the one or more phosphoric acid mono-ester is selected from the group comprising hexyl phosphoric acid mono-ester, heptyl phosphoric acid mono-ester, octyl phosphoric acid mono-ester, 2-ethylhexyl phosphoric acid mono-ester, nonyl phosphoric acid mono-ester, decyl phosphoric acid mono-ester, undecyl phosphoric acid mono-ester, dodecyl phosphoric acid mono-ester, tetradecyl phosphoric acid mono-ester, hexadecyl phosphoric acid mono-ester, heptylnonyl phosphoric acid mono-ester, octadecyl phosphoric acid mono-ester, 2-octyl-1-decylphosphoric acid mono-ester, 2-octyl-1-dodecylphosphoric acid mono-ester and mixtures thereof.

For example, the one or more phosphoric acid mono-ester is selected from the group comprising 2-ethylhexyl phosphoric acid mono-ester, hexadecyl phosphoric acid mono-ester, heptylnonyl phosphoric acid mono-ester, octadecyl phosphoric acid mono-ester, 2-octyl-1-decylphosphoric acid mono-ester, 2-octyl-1-dodecylphosphoric acid mono-ester and mixtures thereof. In one embodiment of the present invention, the one or more phosphoric acid mono-ester is 2-octyl-1-dodecylphosphoric acid mono-ester.

It is appreciated that the expression "one or more" phosphoric acid di-ester means that one or more kinds of phosphoric acid di-ester may be present in the coating layer of the calcium carbonate and/or the phosphoric acid ester blend.

Accordingly, it should be noted that the one or more phosphoric acid di-ester may be one kind of phosphoric acid di-ester. Alternatively, the one or more phosphoric acid di-ester may be a mixture of two or more kinds of phosphoric acid di-ester. For example, the one or more phosphoric acid di-ester may be a mixture of two or three kinds of phosphoric acid di-ester, like two kinds of phosphoric acid di-ester.

In one embodiment of the present invention, the one or more phosphoric acid di-ester consists of an o-phosphoric acid molecule esterified with two alcohols selected from unsaturated or saturated, branched or linear, aliphatic or aromatic alcohols having a total amount of carbon atoms from C6 to C30 in the alcohol substituent. For example, the one or more phosphoric acid di-ester consists of an o-phosphoric acid molecule esterified with two fatty alcohols selected from unsaturated or saturated, branched or linear, aliphatic or aromatic alcohols having a total amount of carbon atoms from C8 to C22, more preferably from C8 to C20 and most preferably from C8 to C18 in the alcohol substituent.

It is appreciated that the two alcohols used for esterifying the phosphoric acid may be independently selected from the same or different, unsaturated or saturated, branched or linear, aliphatic or aromatic alcohols having a total amount of carbon atoms from C6 to C30 in the alcohol substituent. In other words, the one or more phosphoric acid di-ester may comprise two substituents being derived from the same alcohols or the phosphoric acid di-ester molecule may comprise two substituents being derived from different alcohols.

In one embodiment of the present invention, the one or more phosphoric acid di-ester consists of an o-phosphoric acid molecule esterified with two alcohols selected from the same or different, saturated and linear and aliphatic alcohols having a total amount of carbon atoms from C6 to C30, preferably from C8 to C22, more preferably from C8 to C20 and most preferably from C8 to C18 in the alcohol substituent. Alternatively, the one or more phosphoric acid di-ester consists of an o-phosphoric acid molecule esterified with two alcohols selected from the same or different, saturated and branched and aliphatic alcohols having a total amount of carbon atoms from C6 to C30, preferably from C8 to C22, more preferably from C8 to C20 and most preferably from C8 to C18 in the alcohol substituent.

In one embodiment of the present invention, the one or more phosphoric acid di-ester is selected from the group comprising hexyl phosphoric acid di-ester, heptyl phosphoric acid di-ester, octyl phosphoric acid di-ester, 2-ethylhexyl phosphoric acid di-ester, nonyl phosphoric acid di-ester, decyl phosphoric acid di-ester, undecyl phosphoric acid di-ester, dodecyl phosphoric acid di-ester, tetradecyl phosphoric acid di-ester, hexadecyl phosphoric acid di-ester, heptylnonyl phosphoric acid di-ester, octadecyl phosphoric acid di-ester, 2-octyl-1-decylphosphoric acid di-ester, 2-octyl-1-dodecylphosphoric acid di-ester and mixtures thereof.

For example, the one or more phosphoric acid di-ester is selected from the group comprising 2-ethylhexyl phosphoric acid di-ester, hexadecyl phosphoric acid di-ester, heptylnonyl phosphoric acid di-ester, octadecyl phosphoric acid di-ester, 2-octyl-1-decylphosphoric acid di-ester, 2-octyl-1-dodecylphosphoric acid di-ester and mixtures thereof. In one embodiment of the present invention, the one or more phosphoric acid di-ester is 2-octyl-1-dodecylphosphoric acid di-ester.

In one embodiment of the present invention, the one or more phosphoric acid mono-ester is selected from the group comprising 2-ethylhexyl phosphoric acid mono-ester, hexadecyl phosphoric acid mono-ester, heptylnonyl phosphoric acid mono-ester, octadecyl phosphoric acid mono-ester, 2-octyl-1-decylphosphoric acid mono-ester, 2-octyl-1-dodecylphosphoric acid mono-ester and mixtures thereof and the one or more phosphoric acid di-ester is selected from the group comprising 2-ethylhexyl phosphoric acid di-ester, hexadecyl phosphoric acid di-ester, heptylnonyl phosphoric acid di-ester, octadecyl phosphoric acid di-ester, 2-octyl-1-decylphosphoric acid di-ester, 2-octyl-1-dodecylphosphoric acid di-ester and mixtures thereof.

For example, at least a part of the accessible surface area of the calcium carbonate comprises a phosphoric acid ester blend of one phosphoric acid mono-ester and/or reaction products thereof and one phosphoric acid di-ester and/or reaction products thereof. In this case, the one phosphoric acid mono-ester is selected from the group comprising 2-ethylhexyl phosphoric acid mono-ester, hexadecyl phosphoric acid mono-ester, heptylnonyl phosphoric acid mono-ester, octadecyl phosphoric acid mono-ester, 2-octyl-1-decylphosphoric acid mono-ester and 2-octyl-1-dodecylphosphoric acid mono-ester, the one phosphoric acid di-ester is selected from the group comprising 2-ethylhexyl phosphoric acid di-ester, hexadecyl phosphoric acid di-ester, heptylnonyl phosphoric acid di-ester, octadecyl phosphoric acid di-ester, 2-octyl-1-decylphosphoric acid di-ester and 2-octyl-1-dodecylphosphoric acid di-ester.

The phosphoric acid ester blend comprises the one or more phosphoric acid mono-ester and/or reaction products thereof to the one or more phosphoric acid di-ester and/or reaction products thereof in a specific molar ratio. In particular, the molar ratio of the one or more phosphoric acid mono-ester and/or reaction products thereof to the one or more phosphoric acid di-ester and/or reaction products thereof in the treatment layer and/or the phosphoric acid ester blend is from 1:1 to 1:100, preferably from 1:1.1 to 1:60, more preferably from 1:1.1 to 1:40, even more preferably from 1:1.1 to 1:20 and most preferably from 1:1.1 to 1:10.

The wording "molar ratio of the one or more phosphoric acid mono-ester and reaction products thereof to the one or more phosphoric acid di-ester and reaction products thereof" in the meaning of the present invention refers to the sum of the molecular weight of the phosphoric acid mono-ester molecules and/or the sum of the molecular weight of the phosphoric acid mono-ester molecules in the reaction products thereof to the sum of the molecular weight of the phosphoric acid di-ester molecules and/or the sum of the molecular weight of the phosphoric acid di-ester molecules in the reaction products thereof.

In one embodiment of the present invention, the phosphoric acid ester blend coated on at least a part of the surface of the calcium carbonate may further comprise one or more phosphoric acid tri-ester and/or phosphoric acid and/or reaction products thereof.

The term "phosphoric acid tri-ester" in the meaning of the present invention refers to an o-phosphoric acid molecule tri-esterified with three alcohol molecules selected from the same or different, unsaturated or saturated, branched or linear, aliphatic or aromatic alcohols having a total amount of carbon atoms from C6 to C30, preferably from C8 to C22, more preferably from C8 to C20 and most preferably from C8 to C18 in the alcohol substituent.

It is appreciated that the expression "one or more" phosphoric acid tri-ester means that one or more kinds of phosphoric acid tri-ester may be present on at least a part of the accessible surface area of the calcium carbonate.

Accordingly, it should be noted that the one or more phosphoric acid tri-ester may be one kind of phosphoric acid tri-ester. Alternatively, the one or more phosphoric acid tri-ester may be a mixture of two or more kinds of phosphoric acid tri-ester. For example, the one or more phosphoric acid tri-ester may be a mixture of two or three kinds of phosphoric acid tri-ester, like two kinds of phosphoric acid tri-ester.

Additionally or alternatively, the hydrophobising agent can be at least one aliphatic aldehyde having between 6 and 14 carbon atoms.

In this regard, the at least one aliphatic aldehyde represents a surface treatment agent and may be selected from any linear, branched or alicyclic, substituted or non-substituted, saturated or unsaturated aliphatic aldehyde. Said aldehyde is preferably chosen such that the number of carbon atoms is greater than or equal to 6 and more preferably greater than or equal to 8. Furthermore, said aldehyde has generally a number of carbon atoms that is lower or equal to 14, preferably lower or equal to 12 and more preferably lower or equal to 10. In one preferred embodiment, the number of carbon atoms of the aliphatic aldehyde is between 6 and 14, preferably between 6 and 12 and more preferably between 6 and 10.

In another preferred embodiment, the at least one aliphatic aldehyde is preferably chosen such that the number of carbon atoms is between 6 and 12, more preferably between 6 and 9, and most preferably 8 or 9.

The aliphatic aldehyde may be selected from the group of aliphatic aldehydes consisting of hexanal, (E)-2-hexenal, (Z)-2-hexenal, (E)-3-hexenal, (Z)-3-hexenal, (E)-4-hexenal, (Z)-4-hexenal, 5-hexenal, heptanal, (E)-2-heptenal, (Z)-2-heptenal, (E)-3-heptenal, (Z)-3-heptenal, (E)-4-heptenal, (Z)-4-heptenal, (E)-5-heptenal, (Z)-5-heptenal, 6-heptenal, octanal, (E)-2-octenal, (Z)-2-octenal, (E)-3-octenal, (Z)-3-octenal, (E)-4-octenal, (Z)-4-octenal, (E)-5-octenal, (Z)-5-octenal, (E)-6-octenal, (Z)-6-octenal, 7-octenal, nonanal, (E)-2-nonenal, (Z)-2-nonenal, (E)-3-nonenal, (Z)-3-nonenal, (E)-4-nonenal, (Z)-4-nonenal, (E)-5-nonenal, (Z)-5-nonenal, (E)-6-nonenal, (Z)-6-nonenal, (E)-6-nonenal, (Z)-6-nonenal, (E)-7-nonenal, (Z)-7-nonenal, 8-nonenal, decanal, (E)-2-decenal, (Z)-2-decenal, (E)-3-decenal, (Z)-3-decenal, (E)-4-decenal, (Z)-4-decenal, (E)-5-decenal, (Z)-5-decenal, (E)-6-decenal, (Z)-6-decenal, (E)-7-decenal, (Z)-7-decenal, (E)-8-decenal, (Z)-8-decenal, 9-decenal, undecanal, (E)-2-undecenal, (Z)-2-undecenal, (E)-3-undecenal, (Z)-3-undecenal, (E)-4-undecenal, (Z)-4-undecenal, (E)-5-undecenal, (Z)-5-undecenal, (E)-6-undecenal, (Z)-6-undecenal, (E)-7-undecenal, (Z)-7-undecenal, (E)-8-undecenal, (Z)-8-undecenal, (E)-9-undecenal, (Z)-9-undecenal, 10-undecenal, dodecanal, (E)-2-dodecenal, (Z)-2-dodecenal, (E)-3-dodecenal, (Z)-3-dodecenal, (E)-4-dodecenal, (Z)-4-dodecenal, (E)-5-dodecenal, (Z)-5-dodecenal, (E)-6-dodecenal, (Z)-6-dodecenal, (E)-7-dodecenal, (Z)-7-dodecenal, (E)-8-dodecenal, (Z)-8-dodecenal, (E)-9-dodecenal, (Z)-9-dodecenal, (E)-10-dodecenal, (Z)-10-dodecenal, 11-dodecenal, tridecanal, (E)-2-tridecenal, (Z)-2-tridecenal, (E)-3-tridecenal, (Z)-3-tridecenal, (E)-4-tridecenal, (Z)-4-tridecenal, (E)-5-tridecenal, (Z)-5-tridecenal, (E)-6-tridecenal, (Z)-6-tridecenal, (E)-7-tridecenal, (Z)-7-tridecenal, (E)-8-tridecenal, (Z)-8-tridecenal, (E)-9-tridecenal, (Z)-9-tridecenal, (E)-10-tridecenal, (Z)-10-tridecenal, (E)-11-tridecenal, (Z)-11-tridecenal, 12-tridecenal, butadecanal, (E)-2-butadecenal, (Z)-2-butadecenal, (E)-3-butadecenal, (Z)-3-butadecenal, (E)-4-butadecenal, (Z)-4-butadecenal, (E)-5-butadecenal, (Z)-5-butadecenal, (E)-6-butadecenal, (Z)-6-butadecenal, (E)-7-butadecenal, (Z)-7-butadecenal, (E)-8-butadecenal, (Z)-8-butadecenal, (E)-9-butadecenal, (Z)-9-butadecenal, (E)-10-butadecenal, (Z)-10-butadecenal, (E)-11-butadecenal, (Z)-11-butadecenal, (E)-12-butadecenal, (Z)-12-butadecenal, 13-butadecenal, and mixtures thereof. In a preferred embodiment, the aliphatic aldehyde is selected from the group consisting of hexanal, (E)-2-hexenal, (Z)-2-hexenal, (E)-3-hexenal, (Z)-3-hexenal, (E)-4-hexenal, (Z)-4-hexenal, 5-hexenal, heptanal, (E)-2-heptenal, (Z)-2-heptenal, (E)-3-heptenal, (Z)-3-heptenal, (E)-4-heptenal, (Z)-4-heptenal, (E)-5-heptenal, (Z)-5-heptenal, 6-heptenal, octanal, (E)-2-octenal, (Z)-2-octenal, (E)-3-octenal, (Z)-3-octenal, (E)-4-octenal, (Z)-4-octenal, (E)-5-octenal, (Z)-5-octenal, (E)-6-octenal, (Z)-6-octenal, 7-octenal, nonanal, (E)-2-nonenal, (Z)-2-nonenal, (E)-3-nonenal, (Z)-3-nonenal, (E)-4-nonenal, (Z)-4-nonenal, (E)-5-nonenal, (Z)-5-nonenal, (E)-6-nonenal, (Z)-6-nonenal, (E)-7-nonenal, (Z)-7-nonenal, 8-nonenal and mixtures thereof.

In another preferred embodiment, the at least one aliphatic aldehyde is a saturated aliphatic aldehyde. In this case the aliphatic aldehyde is selected from the group consisting of hexanal, heptanal, octanal, nonanal, decanal, undecanal, dodecanal, tridecanal, butadecanal and mixtures thereof. Preferably, the at least one aliphatic aldehyde of step (b) in the form of a saturated aliphatic aldehyde is selected from the group consisting of hexanal, heptanal, octanal, nonanal, decanal, undecanal, dodecanal and mixtures thereof. For instance, the at least one aliphatic aldehyde of step (b) in the form of a saturated aliphatic aldehyde is selected from octanal, nonanal and mixtures thereof.

If a mixture of two aliphatic aldehydes, e.g. two saturated aliphatic aldehydes such as octanal and nonanal is used according to the present invention, the weight ratio of octanal and nonanal is from 70:30 to 30:70 and more preferably from 60:40 to 40:60. In one especially preferred embodiment of the present invention, the weight ratio of octanal and nonanal is about 1:1.

According to one embodiment, the filler is in form of particles having a weight median particle size $d_{50}$ from 15 nm to 200 μm, preferably from 20 nm to 100 μm, more preferably from 50 nm to 50 μm, and most preferably from 100 nm to 2 μm. According to another embodiment, the salifiable alkaline or alkaline earth compound is in form of particles having a weight median particle size $d_{50}$ from 15 nm to 200 μm, preferably from 20 nm to 100 μm, more preferably from 50 nm to 50 μm, and most preferably from 100 nm to 2 μm.

According to one embodiment, the filler has a specific surface area (BET) from 4 to 120 $m^2/g$, preferably from 8 to 50 $m^2/g$, as measured using nitrogen adsorption in the BET method, according to ISO 9277. According to another embodiment, the salifiable alkaline or alkaline earth compound has a specific surface area (BET) from 4 to 120 $m^2/g$, preferably from 8 to 50 $m^2/g$, as measured using nitrogen adsorption in the BET method, according to ISO 9277.

The filler can consist of the salifiable alkaline or alkaline earth compound or it can comprise additional fillers.

According to one embodiment of the present invention, the filler consists of the salifiable alkaline or alkaline earth compound. According to a preferred embodiment of the present invention, in step a) an uncoated substrate comprising at least one optical brightener and a filler is provided, wherein the filler consists of 0 to 60 wt.-% calcium carbonate, based on the total weight of the substrate, preferably the calcium carbonate is ground calcium carbonate, precipitated calcium carbonate and/or surface-treated calcium carbonate.

According to one embodiment, the filler further comprises at least one additional filler, preferably the at least one additional filler is selected from the group consisting of clay, talc, silicate, titanium dioxide, mica, modified calcium carbonate, kaolin, calcinated kaolin, talc, titanium dioxide, gypsum, chalk, satine white, barium sulphate, sodium aluminium silicate, aluminium hydroxide, plastic pigments, latex, and mixtures thereof.

The substrate may also comprise further optional additives. For example, the substrate can further comprise a dispersant, a milling aid, a surfactant, a rheology modifier, a lubricant, a defoamer, a dye, a preservative, a preservative, a starch, a carboxymethyl cellulose, a charge modifier, a pigment, a binder, a hydrophobizing agent, a retention aid, or a mixture thereof. The substrate may also comprise active agents, for example, bioactive molecules as additives, for example, enzymes, chromatic indicators susceptible to change in pH or temperature, or fluorescent materials.

According to one embodiment, the substrate comprises a binder, preferably in an amount from 1 to 50 wt.-%, based on the total weight of the salifiable alkaline or alkaline earth compound, preferably from 3 to 30 wt.-%, and more preferably from 5 to 15 wt.-%.

Any suitable polymeric binder may be present in the substrate. For example, the polymeric binder may be a hydrophilic polymer such as, for example, polyvinyl alcohol, polyvinyl pyrrolidone, gelatin, cellulose ethers, polyoxazolines, polyvinylacetamides, partially hydrolyzed polyvinyl acetate/vinyl alcohol, polyacrylic acid, polyacrylamide, polyalkylene oxide, sulphonated or phosphated polyesters and polystyrenes, casein, zein, albumin, chitin, chitosan, dextran, pectin, collagen derivatives, collodion, agar-agar, arrowroot, guar, carrageenan, starch, tragacanth, xanthan, or rhamsan and mixtures thereof. It is also possible to use other binders such as hydrophobic materials, for example, poly(styrene-co-butadiene), polyurethane latex, polyester latex, poly(n-butyl acrylate), poly(n-butyl methacrylate), poly(2-ethylhexyl acrylate), copolymers of n-butylacrylate and ethylacrylate, copolymers of vinylacetate and n-butylacrylate, and the like and mixtures thereof. Further examples of suitable binders are homopolymers or copolymers of acrylic and/or methacrylic acids, itaconic acid, and acid esters, such as e.g. ethylacrylate, butyl acrylate, styrene, unsubstituted or substituted vinyl chloride, vinyl acetate, ethylene, butadiene, acrylamides and acrylonitriles, silicone resins, water dilutable alkyd resins, acrylic/alkyd resin combinations, natural oils such as linseed oil, and mixtures thereof.

According to one embodiment, the binder is selected from starch, polyvinylalcohol, styrene-butadiene latex, styrene-acrylate, polyvinyl acetate latex, polyolefins, ethylene acrylate, microfibrillated cellulose, nanofibrillated cellulose, microcrystalline cellulose, nanocrystalline cellulose, nanocellulose, cellulose, carboxymethylcellulose, bio-based latex, or mixtures thereof.

According to one embodiment, the substrate comprises a rheology modifier. Preferably the rheology modifier is present in an amount of less than 1 wt.-%, based on the total weight of the filler. Suitable materials are known in the art and the skilled person will select the materials such that they do not negatively affect the detectability of the covert security feature.

According to an exemplary embodiment, the salifiable alkaline or alkaline earth compound is dispersed with a dispersant. The dispersant may be used in an amount from 0.01 to 10 wt.-%, 0.05 to 8 wt.-%, 0.5 to 5 wt.-%, 0.8 to 3 wt.-%, or 1.0 to 1.5 wt.-%, based on the total weight of the salifiable alkaline or alkaline earth compound. In a preferred embodiment, the salifiable alkaline or alkaline earth compound is dispersed with an amount of 0.05 to 5 wt.-%, and preferably with an amount of 0.5 to 5 wt.-% of a dispersant, based on the total weight of the salifiable alkaline or alkaline earth compound. A suitable dispersant is preferably selected from the group comprising homopolymers or copolymers of polycarboxylic acid salts based on, for example, acrylic acid, methacrylic acid, maleic acid, fumaric acid or itaconic acid and acrylamide or mixtures thereof. Homopolymers or copolymers of acrylic acid are especially preferred. The molecular weight $M_w$ of such products is preferably in the range of 2000 to 15000 g/mol, with a molecular weight $M_w$ of 3000 to 7000 g/mol being especially preferred. The molecular weight $M_w$ of such products is also preferably in the range of 2000 to 150 000 g/mol, and an $M_w$ of 15000 to 50 000 g/mol is especially preferred, e.g., 35000 to 45000 g/mol. According to an exemplary embodiment, the dispersant is polyacrylate.

The substrate of step a) may be produced by any suitable method known to the skilled person. According to one embodiment of the present invention, the at least one optical brightener and optional filler, comprising from 0 to 60 wt.-% of a salifiable alkaline or alkaline earth compound, based on the total weight of the substrate, are applied into the uncoated substrate via surface sizing. For example, the substrate of step a) can be prepared by i) providing an uncoated substrate, and ii) applying a surface sizing composition comprising at least one optical brightener and optionally a filler, wherein the filler comprises from 0 to 60 wt.-% of a salifiable alkaline or alkaline earth compound, based on the total weight of the substrate, on at least one side of the substrate to form a surface sizing layer.

Method Step b)

According to step b) of the method of the present invention, a liquid treatment composition comprising at least one acid is provided.

The liquid treatment composition may comprise any inorganic or organic acid that forms $CO_2$ when it reacts with a salifiable alkaline or alkaline earth compound. According to one embodiment, the at least one acid is an organic acid, preferably a monocarboxylic, dicarboxylic or tricarboxylic acid.

According to one embodiment, the at least one acid is a strong acid having a $pK_a$ of 0 or less at 20° C. According to another embodiment, the at least one acid is a medium-strong acid having a $pK_a$ value from 0 to 2.5 at 20° C. If the $pK_a$ at 20° C. is 0 or less, the acid is preferably selected from sulphuric acid, hydrochloric acid, or mixtures thereof. If the $pK_a$ at 20° C. is from 0 to 2.5, the acid is preferably selected from $H_2SO_3$, $H_3PO_4$, oxalic acid, or mixtures thereof. However, acids having a $pK_a$ of more than 2.5 may also be used, for example, suberic acid, succinic acid, acetic acid, citric acid, formic acid, sulphamic acid, tartaric acid, benzoic acid, or phytic acid.

The at least one acid can also be an acidic salt, for example, $HSO_4^-$, $H_2PO_4^-$ or $HPO_4^{2-}$, being at least partially neutralized by a corresponding cation such as $Li^+$, $Na^{+'}$ $K^+$, $Mg^{2+}$ or $Ca^{2+}$. The at least one acid can also be a mixture of one or more acids and one or more acidic salts.

According to one embodiment of the present invention, the at least one acid is selected from the group consisting of hydrochloric acid, sulphuric acid, sulphurous acid, phosphoric acid, citric acid, oxalic acid, acetic acid, formic acid, sulphamic acid, tartaric acid, phytic acid, boric acid, succinic acid, suberic acid, benzoic acid, adipic acid, pimelic acid, azelaic acid, sebaic acid, isocitric acid, aconitic acid, propane-1,2,3-tricarboxylic acid, trimesic acid, glycolic acid, lactic acid, mandelic acid, acidic organosulphur compounds, acidic organophosphorus compounds, $HSO_4^-$, $H_2PO_4^-$ or $HPO_4^{2-}$, being at least partially neutralized by a corresponding cation selected from $Li^+$, $Na^+$ $K^+$, $Mg^{2+}$ or $Ca^{2+}$, and mixtures thereof. According to a preferred embodiment, the at least one acid is selected from the group consisting of hydrochloric acid, sulphuric acid, sulphurous acid, phosphoric acid, oxalic acid, boric acid, suberic acid, succinic acid, sulphamic acid, tartaric acid, and mixtures thereof, more preferably the at least one acid is selected from the group consisting of sulphuric acid, phosphoric acid, boric acid, suberic acid, sulphamic acid, tartaric acid, and mixtures thereof, and most preferably the at least one acid is phosphoric acid and/or sulphuric acid.

Acidic organosulphur compounds may be selected from sulphonic acids such as Nafion, p-toluenesulphonic acid, methanesulphonic acid, thiocarboxylic acids, sulphinic acids and/or sulphenic acids. Examples for acidic organophosphorus compounds are aminomethylphosphonic acid, 1-hydroxyethylidene-1,1-diphosphonic acid (HEDP), amino tris (methylenephosphonic acid) (ATMP), ethylenediamine tetra (methylene phosphonic acid) (EDTMP), tetramethylenediamine tetra(methylene phosphonic acid) (TDTMP), hexamethylenediamine tetra(methylene phosphonic acid) (HDTMP), diethylenetriamine penta(methylene phosphonic acid) (DTPMP), phosphonobutane-tricarboxylic acid (PBTC), N-(phosphonomethyl)iminodiacetic acid (PMIDA), 2-carboxyethyl phosphonic acid (CEPA), 2-hydroxyphosphonocarboxylic acid (HPAA), Amino-tris-(methylenephosphonic acid) (AMP), or di-(2-ethylhexyl) phosphoric acid.

The at least one acid may consist of only one type of acid. Alternatively, the at least one acid can consist of two or more types of acids.

The at least one acid may be applied in concentrated form or in diluted form. According to one embodiment of the present invention, the liquid treatment composition comprises at least one acid and water. According to another embodiment of the present invention, the liquid treatment composition comprises at least one acid and a solvent. According to another embodiment of the present invention, the liquid treatment composition comprises at least one acid, water, and a solvent. Suitable solvents are known in the art and are, for example, aliphatic alcohols, ethers and diethers having from 4 to 14 carbon atoms, glycols, alkoxylated glycols, glycol ethers, alkoxylated aromatic alcohols, aromatic alcohols, mixtures thereof, or mixtures thereof with water.

According to still another embodiment of the present invention, the liquid treatment composition comprises at least one acid, water, and a surfactant. Suitable surfactants are known to the skilled person and may be preferably selected from non-ionic surfactants. According to one embodiment the non-ionic surfactant is an alkylphenol hydroxypolyethylene, a polyethoxylated sorbitan ester, or a mixture thereof. Examples of a suitable alkylphenol hydroxypolyethylene are surfactants of the triton-X series such as triton X-15, triton X-35, triton X-45, triton X-100, triton X-102, triton X-114, triton X-165, triton X-305, triton X-405, or triton X-705, which are, for example, commercially available from Dow Chemical Company, USA. Examples of a suitable polyethoxylated sorbitan ester are surfactants of the tween series such as tween 20 (polysorbate 20), tween 40 (polysorbate 40), tween 60 (polysorbate 60), tween 65 (polysorbate 65), or tween 80 (polysorbate 80), which are, for example, commercially available from Merck KGaA, Germany. According to one embodiment the surfactant is a non-ionic surfactant, preferably triton X-100 and/or tween 80, and most preferably triton X-100. The surfactant may be present in the liquid treatment composition in an amount of up to 8 wt.-%, based on the total weight of the liquid treatment composition.

According to one exemplary embodiment, the liquid treatment composition comprises phosphoric acid, ethanol, and water, preferably the liquid treatment composition comprises 30 to 50 wt.-% phosphoric acid, 10 to 30 wt.-% ethanol, and 20 to 40 wt.-% water, based on the total weight of the liquid treatment composition. According to another exemplary embodiment, the liquid treatment composition comprises 20 to 40 vol.-% phosphoric acid, 20 to 40 vol.-% ethanol, and 20 to 40 vol.-% water, based on the total volume of the liquid treatment composition. It is appreciated that the balance up to 100 wt.-%, based on the total weight of the liquid treatment composition, is water. It is also appreciated that the balance up to 100 vol.-%, based on the total volume of the liquid treatment composition, is water.

According to one exemplary embodiment, the liquid treatment composition comprises sulphuric acid, ethanol, and water, preferably the liquid treatment composition comprises 1 to 10 wt.-% sulphuric acid, 10 to 30 wt.-% ethanol, and 70 to 90 wt.-% water, based on the total weight of the liquid treatment composition. According to another exemplary embodiment, the liquid treatment composition comprises 10 to 30 vol.-% sulphuric acid, 10 to 30 vol.-% ethanol, and 50 to 80 vol.-% water, based on the total volume of the liquid treatment composition. It is appreciated that the balance up to 100 wt.-%, based on the total weight of the liquid treatment composition, is water. It is also appreciated that the balance up to 100 vol.-%, based on the total volume of the liquid treatment composition, is water. According to one exemplary embodiment, the liquid treatment composition comprises phosphoric acid, surfactant, and water, preferably the liquid treatment composition comprises 30 to 50 wt.-% phosphoric acid, 1 to 6 wt.-% surfactant, and 40 to 70 wt.-% water, based on the total weight of the liquid treatment composition. According to another exemplary embodiment, the liquid treatment composition comprises sulphuric acid, surfactant, and water, preferably the liquid treatment composition comprises 1 to 10 wt.-% sulphuric acid, 1 to 6 wt.-% surfactant, and 80 to 98 wt.-% water, based on the total weight of the liquid treatment composition. The surfactant may be a non-ionic surfactant, preferably triton X-100 and/or tween 80, and most preferably triton X-100. It is appreciated that the balance up to 100 wt.-%, based on the total weight of the liquid treatment composition, is water.

According to one embodiment, the liquid treatment composition comprises the at least one acid in an amount from 0.1 to 100 wt.-%, based on the total weight of the liquid treatment composition, preferably in an amount from 1 to 80 wt.-%, more preferably in an amount from 2 to 50 wt.-%, and most preferably in an amount from 5 to 30 wt.-%.

In addition to the at least one acid, the liquid treatment composition may further comprise a fluorescent dye, a phosphorescent dye, an ultraviolet absorbing dye, a near infrared absorbing dye, a thermochromic dye, a halochromic dye, metal ions, transition metal ions, magnetic particles, quantum dots, or a mixture thereof. Such additional compounds can equip the substrate with additional features, such as specific light absorbing properties, electromagnetic radiation reflection properties, fluorescence properties, phosphorescence properties, magnetic properties, or electric conductivity.

Method Step c)

According to method step c), the liquid treatment composition is applied onto the at least one region of the substrate in form of a preselected pattern to form an embedded, UV-visible pattern. "UV-visible" in the context of the present application means that the embedded pattern can be observed if it is irradiated with UV light, i.e. with electromagnetic radiation having a wavelength from less than 400 to 100 nm.

The liquid treatment composition can be applied onto at least one region of the substrate by any suitable method known in the art.

According to one embodiment, the liquid treatment composition is applied by spray coating, inkjet printing, offset printing, flexographic printing, screen printing, plotting, contact stamping, rotogravure printing, spin coating, reverse (counter-rotating) gravure coating, slot coating, curtain coating, slide bed coating, film press, metered film press, blade coating, brush coating, stamping and/or a pencil. According to one embodiment the liquid treatment composition is applied by spray coating. The spray coating may be combined with a shutter in order to create a pattern. Preferably, the liquid treatment composition is applied by inkjet printing, for example, by continuous inkjet printing, intermitting inkjet printing or drop-on-demand inkjet printing.

The inkjet printing technology may provide the possibility to place very small droplets onto the substrate, which allows to form high resolution patterns within the substrate. According to one embodiment, the liquid treatment composition is applied to the substrate in form of droplets. Depending on the inkjet printer, the droplets may have a volume in the range from 10 μl to 0.5 pl, wherein "pl" means "picoliter". According to one embodiment, the droplets have a volume of less than or equal to 10 μl, preferably less than or equal to 100 nl, more preferably less than or equal to 1 nl, even more preferably less than or equal to 10 pl, and most preferably less than or equal to 0.5 pl. For example, the droplets may have a volume from 10 μl to 1 μl, from 1 μl to 100 nl, from 100 nl to 10 nl, from 10 nl to 1 nl, from 1 nl to 100 pl, from 100 pl to 10 pl, from 10 pl to 1 pl, or of about 0.5 pl.

According to another embodiment, the liquid treatment composition is applied to the substrate in form of droplets to form surface-modified pixels on and/or within the coating layer. The pixels may have a diameter of less than 5 mm, preferably less 1000 μm, more preferably less than 200 μm, and most preferably less than 100 μm, or even less than 10 μm.

The liquid treatment composition can be applied onto the substrate by depositing the treatment composition onto the first side of the substrate. Alternatively or additionally, the liquid treatment composition can be applied onto the reverse side of the substrate.

The application of the liquid treatment composition onto the substrate can be carried out at a surface temperature of the substrate, which is at room temperature, i.e. at a temperature of 20±+2° C., or at an elevated temperature, for example, at about 70° C. Carrying out method step b) at an elevated temperature may enhance the drying of the liquid treatment composition, and, hence, may reduce production time. According to one embodiment, method step b) is carried out at a substrate surface temperature of more than 5° C., preferably more than 10° C., more preferably more than 15° C., and most preferably more than 20° C. According to one embodiment, method step b) is carried out at a substrate surface temperature which is in the range from 5 to 120° C., more preferably in the range from 10 to 100° C., more preferably in the range from 15 to 90° C., and most preferably in the range from 20 to 80° C.

According to the method of the present invention, the liquid treatment composition is applied onto at least one region of the substrate in form of a preselected pattern. The preselected pattern may be a continuous layer, a pattern, a pattern of repetitive elements and/or a repetitive combination(s) of elements.

According to one embodiment of the present invention, the liquid treatment composition is continuously applied to the entire substrate. Thereby, a continuous embedded, UV-visible region can be formed.

According to another embodiment, the liquid treatment composition is applied to the substrate in form of a pattern of repetitive elements or repetitive combination(s) of elements, preferably selected from the group consisting of circles, dots, triangles, rectangles, squares, or lines.

According to one embodiment, the preselected pattern is a one-dimensional bar code, a two-dimensional bar code, a three-dimensional bar code, a QR-code, a dot matrix code, a security mark, a number, a letter, an alphanumeric symbol, a logo, an image, a shape, a signature, a design, or a combination thereof. The pattern may have a resolution of more than 10 dpi, preferably more than 50 dpi, more preferably more than 100 dpi, even more preferably more than 1000 dpi, and most preferably more than 10000 dpi, wherein dpi means dots per inch.

Without being bound to any theory, it is believed that by the application of the liquid treatment composition onto at least one region of the substrate, the optical brightener and, if present, the salifiable alkaline or alkaline earth compound of the external surface reacts with the acid included in the treatment composition. The inventors surprisingly found that in the regions of the substrate, which were treated with the liquid treatment composition, the fluorescence intensity of the optical brightener was reduced. Furthermore, it was found that the salifiable alkaline or alkaline earth compound is at least partially converted into a corresponding acid salt, which has a different chemical composition and crystal structure compared to the original material. In case the salifiable alkaline or alkaline earth compound is an alkaline or alkaline earth carbonate, for example, the compound would be converted by the acid treatment into a non-carbonate alkaline or alkaline earth salt of the applied acid. The inventors surprisingly found that in the regions of the substrate, which contained an optical brightener and a salifiable alkaline or alkaline earth compound and were treated with the liquid treatment composition, the fluorescence intensity of the optical brightener can be increased. Without being bound to any theory, it is believed that salifiable alkaline or alkaline earth compounds may quench the fluorescence of the optical brightener and due to their conversion into the corresponding acid salts said quenching effect might be at least partially eliminated.

By applying the liquid treatment composition according to method step c), the salifiable alkaline or alkaline earth compound can be converted into a water-insoluble or water-soluble salt.

According to one embodiment, the embedded, UV-visible pattern comprises an acid salt of the salifiable alkaline or alkaline earth compound. According to another embodiment, the embedded, UV-visible pattern comprises a non-carbonate alkaline or alkaline earth salt, preferably a water-insoluble non-carbonate alkaline or alkaline earth salt. According to a preferred embodiment, the embedded, UV-visible pattern comprises a non-carbonate calcium salt, preferably a water-insoluble non-carbonate calcium salt. In the meaning of the present invention "water-insoluble" materials are defined as materials which, when mixed with deionised water and filtered on a filter having a 0.2 μm pore size at 20° C. to recover the liquid filtrate, provide less than or equal to 0.1 g of recovered solid material following evaporation at 95 to 100° C. of 100 g of said liquid filtrate. "Water-soluble" materials are defined as materials leading to the recovery of greater than 0.1 g of recovered solid material following evaporation at 95 to 100° C. of 100 g of said liquid filtrate.

According to one embodiment of the present invention, the uncoated substrate comprises the salifiable alkaline or alkaline earth compound in an amount of at least 1 wt.-%, based on the total weight of the substrate, the liquid treatment composition comprises phosphoric acid, and the obtained embedded, UV-visible pattern comprises at least one alkaline or alkaline earth phosphate. According to a preferred embodiment, the uncoated substrate comprises calcium carbonate in an amount of at least 1 wt.-%, based on the total weight of the substrate, the liquid treatment composition comprises phosphoric acid, and the obtained UV-visible pattern comprises hydroxyapatite, calcium hydrogen phosphate hydrate, calcium phosphate, brushite, and combinations thereof, preferably calcium phosphate and/or brushite.

According to another embodiment of the present invention, the uncoated substrate comprises the salifiable alkaline or alkaline earth compound in an amount of at least 1 wt.-%, based on the total weight of the substrate, the liquid treatment composition comprises sulphuric acid, and the obtained embedded, UV-visible pattern comprises at least one alkaline or alkaline earth sulphate. According to a preferred embodiment, the uncoated substrate comprises calcium carbonate in an amount of at least 1 wt.-%, based on the total weight of the substrate, the liquid treatment composition comprises phosphoric acid, and the obtained surface-modified regions comprise gypsum.

Additional Process Steps

According to one embodiment of the invention, the method further comprises a step d) of applying a protective layer above the embedded, UV-visible pattern.

The protective layer can be made from any material, which is suitable to protect the underlying pattern against unwanted environmental impacts or mechanical wear. Examples for suitable materials are resins, varnishes, silicones, polymers, metal foils, or cellulose-based materials.

The protective layer may be applied above the embedded, UV-visible pattern by any method known in the art and suitable for the material of the protective layer. Suitable methods are, for example, air knife coating, electrostatic coating, metering size press, film coating, spray coating, extrusion coating, wound wire rod coating, slot coating, slide hopper coating, gravure, curtain coating, high speed coating, lamination, printing, adhesive bonding, and the like.

According to one embodiment of the present invention, the protective layer is applied above the embedded, UV-visible pattern and the surrounding substrate surface.

According to one embodiment, the protective layer is a removable protective layer.

According to one embodiment of the present invention, the method further comprises a step d) of applying a protective layer above the embedded, UV-visible pattern, wherein the protective layer is an overprint and is applied by printing or the protective layer is a laminate and is applied by laminating. Thus, the protective layer can be an overprint or a laminate.

According to a further embodiment of the present invention, the substrate provided in step a) comprises on the first side and a reverse side, and in step c) the liquid treatment composition comprising at least one acid is applied onto the first and the reverse side to form an embedded, UV-visible pattern. Step c) may be carried out for each side separately or may be carried out on the first and the reverse side simultaneously.

According to one embodiment of the present invention, method step c) is carried out two or more times using a different or the same liquid treatment composition. Thereby, different embedded, UV-visible patterns with different properties can be created.

The Substrate with the Embedded, UV-Visible Pattern

According to one aspect of the present invention, a substrate comprising an embedded, UV-visible pattern, obtainable by a method according to the present invention, is provided.

According to one embodiment of the present invention, a substrate comprising an embedded, UV-visible pattern is provided, wherein the embedded, UV-visible pattern comprises an acid salt of the salifiable alkaline or alkaline earth compound. Preferably, the salifiable alkaline or alkaline earth compound is an alkaline or alkaline earth carbonate, preferably a calcium carbonate, and the surface-modified region comprises a non-carbonate alkaline or alkaline earth salt, preferably a non-carbonate calcium salt.

The inventors of the present invention found that due to the change in the fluorescence intensity of the optical brightener, the formed embedded pattern can be detected by irradiating the substrate with UV light, i.e. electromagnetic radiation having a wavelength from less than 400 to 100 nm, while it is invisible to the naked or unaided human eye at ambient or visible light, i.e. when irradiated with electromagnetic radiation having a wavelength from 400 to 700 nm. Thus, the method of the present invention provides the possibility of providing a substrate with a covert marking, which is invisible at ambient conditions but can be easily and immediately recognized under UV-light. The embedded, UV-visible pattern created by the method of the present invention has also the advantage that it is not possible to reproduce it by copying using a photocopy machine. The method of the present invention could also be used to permanently validate or invalidate tickets or documents in a discreet way.

Furthermore, the present invention provides the possibility to equip said pattern with additional functionalities by adding further compounds to the liquid treatment composition. For example, the pattern can be detected under UV light by adding a UV absorbing dye or can be rendered machine readable by adding magnetic particles or electrically conductive particles.

According to the present invention the embedded, UV-visible pattern is detectable under UV-light. Suitable methods for detection under UV-light are known to the skilled person. For example, a simple (hand held) UV-lamp may be used or a UV-vis spectrometer.

The embedded, UV-visible pattern of the present invention may also be combined with security features such as optically variable features, embossing, watermarks, threads, or holograms.

Generally the substrate with an embedded, UV-visible pattern of the present invention may be employed in any kind of product that should be marked, for example, in products that are subject to counterfeiting, imitation, or copying, in non-security products, or decorative products.

According to a further aspect of the present invention, a product comprising a substrate according to the present invention is provided, wherein the product is a branded product, a security document, a non-secure document, or a decorative product, preferably the product is a perfume, a drug, a tobacco product, an alcoholic drug, a bottle, a garment, a packaging, a container, a sporting good, a toy, a game, a mobile phone, a compact disc (CD), a digital video disc (DVD), a blue ray disc, a machine, a tool, a car part, a sticker, a label, a tag, a poster, a passport, a driving licence, a bank card, a credit card, a bond, a ticket, a postage or tax stamp, a banknote, a certificate, a brand authentication tag, a business card, a greeting card, a voucher, a tax banderol, or a wall paper.

As already mentioned above, the substrate according to the present invention is suitable for a wide range of applications. The skilled person will appropriately select the type of substrate for the desired application.

According to one embodiment of the present invention, the substrate according to the present invention is used in security applications, in overt security elements, in covert security elements, in brand protection, in microlettering, in micro imaging, in decorative applications, in artistic applications, in visual applications, or in packaging applications.

The scope and interest of the present invention will be better understood based on the following figures and examples which are intended to illustrate certain embodiments of the present invention and are non-limitative.

EXAMPLES

Figure 1:
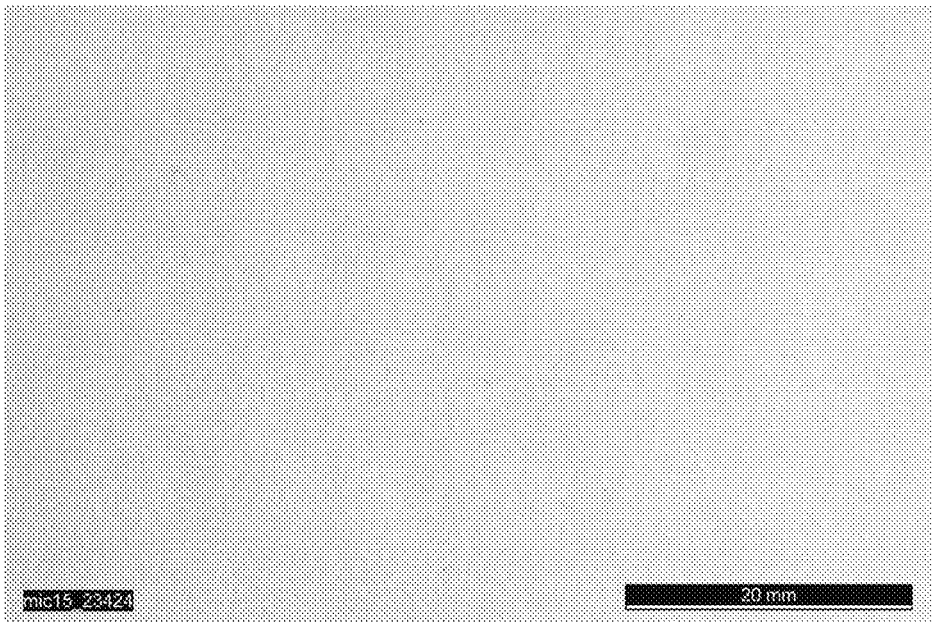
FIG. 1 shows an image of a substrate comprising an embedded, UV-visible pattern in form of a logo and a number series under ambient light.

In the following, measurement methods implemented in the examples are described.

1. Methods

Photographs

Images of the prepared samples were recorded with an EOS 600D digital camera equipped with a Canon Macro, EF-S 60 mm, 1:2.8 USM (Canon, Japan). UV light with a wavelength of 366 nm was provided by UV hand lamp NU-4, serial no. 10 31 002 H466.1 with a 366 nm, 4 watt tube (Herolab GmbH Laborgeräte, Germany).

Fluorescence Spectroscopy

The prepared samples were examined with a LS 45 Fluorescence Spectrometer (PerkinElmer Inc., USA).

CIE Lab Coordinates, Whiteness and Gloss

The CIE lab coordinates of the prepared samples were recorded with a Techkon SP810 lambda densitometer (Techkon GmbH, Germany).

The whiteness of the prepared samples was measured with a Techkon SpectroDens Premium densitometer (Techkon GmbH, Germany).

The gloss of the prepared samples was measured at an incident angle of 85° (haze gloss) using a BYK-Gardner hazemeter (BYK-Gardner GmbH, Germany).

2. Materials

Optical Brightener

Tetrasulphonated optical brightener (Leucophor UHF), commercially available from Archroma Paper, Switzerland.

Filler

Precipitated calcium carbonate ($d_{50}$=1.8 μm, $d_{98}$=8 μm), commercially available from Omya AG, Switzerland. The precipitated calcium carbonate was provided in form of an undispersed, aqueous suspension having a solids content of 17 wt.-%.

Liquid Treatment Composition 41 wt.-% phosphoric acid, 23 wt.-% ethanol, and 36 wt.-% water (wt.-% are based on the total weight of the liquid treatment composition).

3. Examples

Example 1—Preparation of Paper Substrates 60 g (dry) pulp (100% eucalyptus 30° SR) were diluted in 10 $dm^3$ tap water. Subsequently, the filler, if present, was added in an amount so as to obtain an overall filler content of 20 wt.-%, based on the final paper weight, and the optical brightener, if present, was added in an amount so as to obtain an overall content of 12 kg/ton, based on the final paper weight. The suspension was stirred for 30 minutes. Subsequently, 0.06% (based on dry weight) of a polyacrylamide derivate (Percol® 1540, commercially available from BASF, Germany) was added as a retention aid and sheets of 80 $g/m^2$ were formed using the Rapid-Kothen hand sheet former. Each sheet was dried using the Rapid-Kothen drier. The composition of the produced paper substrates is given in Table 1 below.

TABLE 1

Compositions of prepared paper substrates (*based on the final paper weight).

| Substrate | Filler amount [wt.-%*] | Optical brightener [kg/t*] |
|---|---|---|
| 1 (comparative) | — | — |
| 2 | — | 12 |
| 3 (comparative) | 20 | — |
| 4 | 20 | 12 |

Example 2—Preparation of Embedded, UV-Visible Pattern

A preselected pattern in form of a logo and a number series was created on substrates 1 to 4 prepared in Example 1 by applying the liquid treatment composition. The liquid treatment composition was deposited onto the substrate by inkjet printing using a Dimatix Materials Printer (DMP) of Fujifilm Dimatix Inc., USA, with a cartridge-based inkjet printhead having a drop volume of 10 pl. The print direction was from left to right, one row (line) at a time. The liquid treatment compositions were applied onto the substrates with a drop volume of 10 pl and using different drop spacings. The optical properties of the prepared substrates were tested by determining the CIE lab coordinates, the whiteness, and the gloss at 850. The results are compiled in Table 2 below.

TABLE 2

Optical properties of substrates with embedded, UV-visible pattern and comparative substrates.

| | Amount of liquid treatment composition | | | |
|---|---|---|---|---|
| | — | 4 ml/m$^2$ | 6.3 ml/m$^2$ | 11 ml/m$^2$ |
| | | Drop spacing | | |
| | — | 50 μm | 40 μm | 30 μm |
| Substrate 4 | | | | |
| L | 94.04 | 94.07 | 94.06 | 93.64 |
| a | 1.32 | 1.33 | 1.09 | 1.04 |
| b | −3.53 | −3.55 | −3.22 | −3.13 |
| Whiteness (CIE) | 104.2 | 103.8 | 101.4 | 100.8 |
| Gloss (85°) | 2.0 | 2.1 | 2.3 | 2.6 |
| Substrate 3 (comparative) | | | | |
| L | 93.67 | 93.66 | 93.32 | 93.39 |
| a | −0.14 | −0.13 | −0.15 | −0.15 |
| b | 1.12 | 1.12 | 1.02 | 0.96 |
| Whiteness (CIE) | 83.6 | 83.8 | 83.6 | 83.7 |
| Gloss (85°) | 2.3 | 2.4 | 2.3 | 2.3 |
| Substrate 2 | | | | |
| L | 90.69 | 90.31 | 90.33 | 90.62 |
| a | 1.64 | 1.23 | 1.21 | 1.14 |
| b | −4.63 | −3.77 | −3.61 | −3.32 |
| Whiteness (CIE) | 102.7 | 97.5 | 97 | 94.9 |
| Gloss (85°) | 2.7 | 2.7 | 2.9 | 3.0 |
| Substrate 1 (comparative) | | | | |
| L | 90.61 | 90.42 | 90.39 | 90.15 |
| a | −0.17 | −0.18 | −0.19 | −0.18 |
| b | 1.22 | 1.25 | 1.23 | 1.23 |
| Whiteness (CIE) | 77.6 | 76.2 | 75.6 | 76.5 |
| Gloss (85°) | 3.0 | 2.8 | 2.9 | 2.9 |

Figure 2:
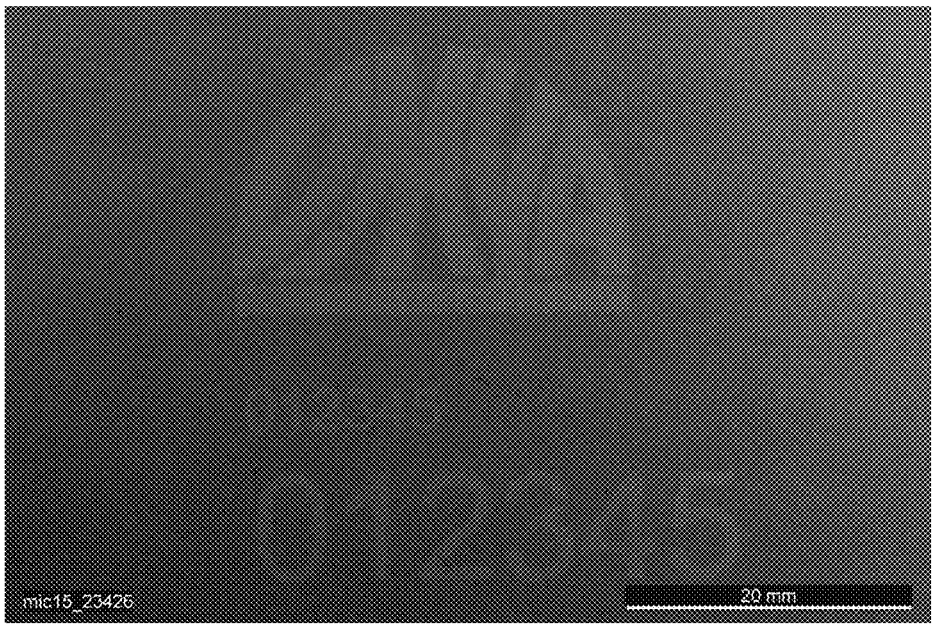
FIG. 2 shows an image of a substrate comprising an embedded, UV-visible pattern in form of a logo and a number series under ambient light with addition of UV light having a wavelength of 366 nm.

As can be gathered from Table 2, there is an observable change in CIE whiteness for the inventive substrates 2 and 4, which is due to the fact that the excitation light of the used densitometers contains some UV light (D65 standard light source). FIGS. 1 and 2 show images of the substrate 4, which was printed with 11 ml/m$^2$ liquid treatment composition and a drop spacing of 30 m. While in FIG. 1, which was recorded at ambient light illumination, the printed logo and number series is not visible, the same is clearly visible in FIG. 2, which was recorded in the presence of UV light having a wavelength of 366 nm (the darker appearance of the image compared to FIG. 1 is a result of the greyscale conversion of the originally blue appearance of the surface caused by the UV light).

Figure 3:
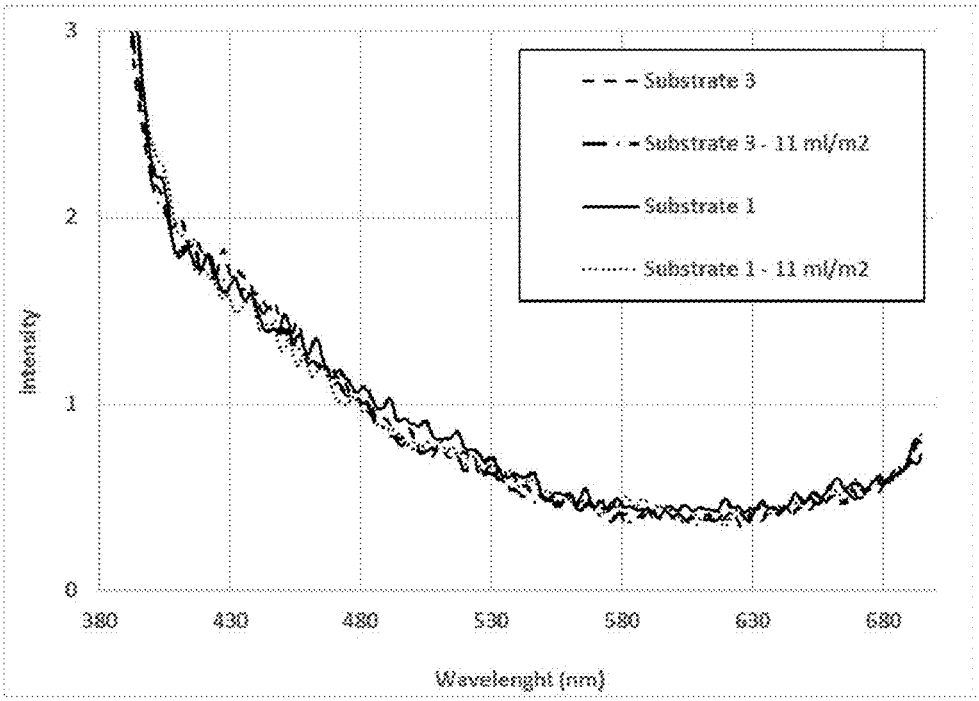
FIG. 3 shows fluorescence spectra of a comparative substrate without any optical brightener or filler, and comparative substrate comprising calcium carbonate but no optical brightener.
Figure 4:
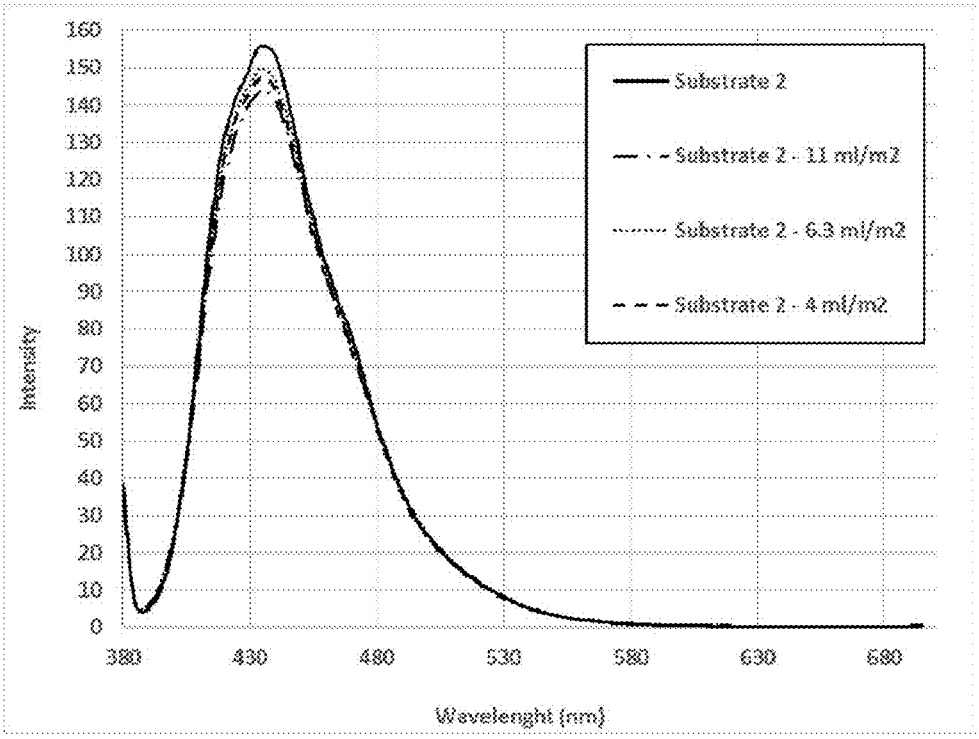
FIG. 4 shows fluorescence spectra of a comparative substrate and a substrate according to the present invention comprising an optical brightener.
Figure 5:
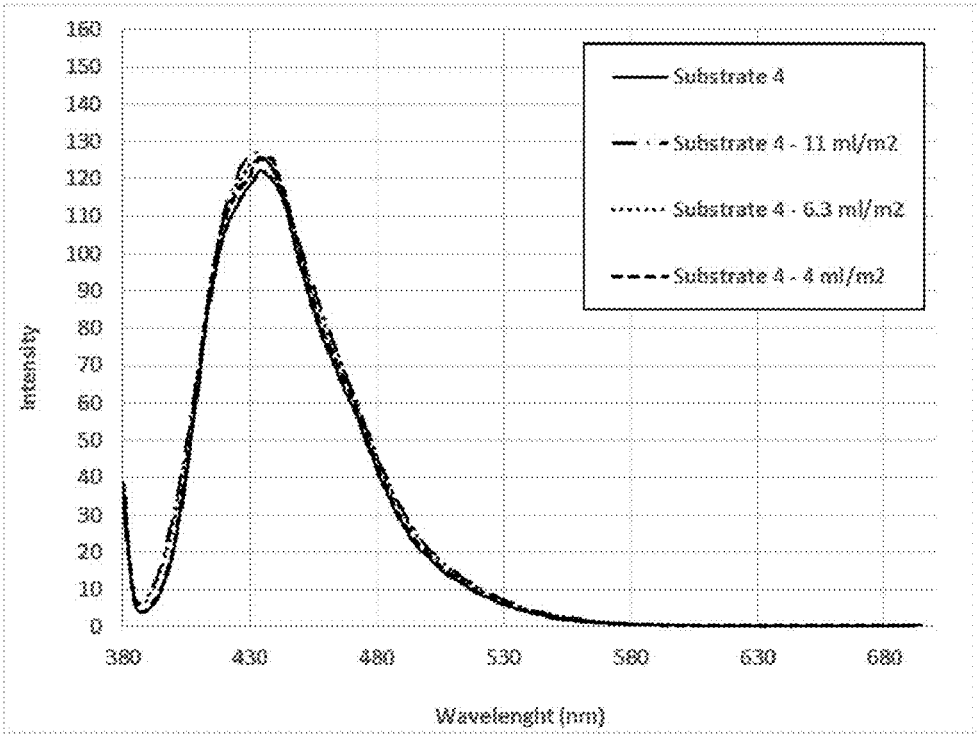
FIG. 5 shows fluorescence spectra of a comparative substrate and a substrate according to the present invention comprising an optical brightener and calcium carbonate.

FIGS. 3 to 5 show fluorescence spectra of printed substrates 1 to 4. As can be gathered from FIG. 4 the fluorescence main peak is decreased when the inventive substrate 2 containing the optical brightener is printed with the liquid treatment composition. FIG. 5 shows that the fluorescence main peak is increased when the inventive substrate 4 containing the optical brightener and the filler is printed with the liquid treatment composition. No change in fluorescence was observed for comparative substrates 1 and 3 (see FIG. 3).

Thus, the results confirm that by using the method of the present invention substrates with embedded patterns can be prepared, wherein the pattern is invisible at ambient light but detectable under UV light.

The invention claimed is:

1. A method of manufacturing a substrate with an embedded, UV-visible pattern, the method comprising the following steps: a) providing an uncoated substrate comprising at least one optical brightener and a filler, wherein the filler comprises from 0 to 60 wt.-% of a salifiable alkaline or alkaline earth compound, based on the total weight of the substrate, b) providing a liquid treatment composition comprising at least one acid, and c) applying the liquid treatment composition onto at least one region of the substrate in form of a preselected pattern to form an embedded, UV-visible pattern.

2. The method of claim 1, wherein the filler comprises the salifiable alkaline or alkaline earth compound in an amount of at least 1 wt. %, based on the total weight of the substrate.

3. The method of claim 1, wherein the optical brightener is present in an amount of at least 0.001 wt. %, based on the total weight of the substrate.

4. The method of claim 1, wherein the optical brightener is selected from the group consisting of stilbene derivates, pyrazolin derivates, cumarin derivates, benzoxazol derivates, naphthalimide derivates, pyrene derivates, derivatives of diaminostilbenedisulfonic acid, derivatives of diaminostilbenetetrasulfonic acid, derivatives of diaminostilbenehexasulfonic acid, 4,4'-diamino-2,2'-stilbenedisulfonic acid, 4 4'-bis(benzoxazolyl)-cis-stilbene, 2 5-bis(benzoxazol-2-yl)thiophene, 5-[(4-anilino-6-methoxy-1,3,5-triazin-2-yl)amino]-2-[(E)-2-[4-[(4-anilino-6-methoxy-1,3,5-triazin-2-yl)amino]-2-sulfonatophenyl]ethenyl]benzenesulfonate (leucophor PC), and mixtures thereof.

5. The method of claim 1, wherein the substrate is selected from the group consisting of paper, cardboard, containerboard, or plastic.

6. The method of claim 1, wherein the salifiable alkaline or alkaline earth compound is an alkaline or alkaline earth oxide, an alkaline or alkaline earth hydroxide, an alkaline or alkaline earth alkoxide, an alkaline or alkaline earth methylcarbonate, an alkaline or alkaline earth hydroxycarbonate, an alkaline or alkaline earth bicarbonate, an alkaline or alkaline earth carbonate, lithium carbonate, sodium carbonate, potassium carbonate, magnesium carbonate, calcium magnesium carbonate, calcium carbonate, is a ground calcium carbonate, a precipitated calcium carbonate, a surface-treated calcium carbonate, or mixtures thereof.

7. The method of claim 1, wherein the salifiable alkaline or alkaline earth compound is in form of particles having a weight median particle size $d_{50}$ from 15 nm to 200 μm.

8. The method of claim 1, wherein the at least one acid is selected from the group consisting of hydrochloric acid, sulphuric acid, sulphurous acid, phosphoric acid, citric acid, oxalic acid, acetic acid, formic acid, sulphamic acid, tartaric acid, phytic acid, boric acid, succinic acid, suberic acid, benzoic acid, adipic acid, pimelic acid, azelaic acid, sebaic acid, isocitric acid, aconitic acid, propane-1,2,3-tricarboxylic acid, trimesic acid, glycolic acid, lactic acid, mandelic acid, acidic organosulfur compounds, acidic organophosphorus compounds, $HSO_4^-$, $H_2PO_4^-$, $HPO_4^{2-}$, being at least partially neutralized by a corresponding cation selected from Li, $Na^+$, $K^+$, $Mg^{2+}$ or $Ca^{2+}$, and mixtures thereof.

9. The method of claim 1, wherein the liquid treatment composition further comprises a fluorescent dye, a phosphorescent dye, an ultraviolet absorbing dye, a near infrared absorbing dye, a thermochromic dye, a halochromic dye, metal ions, transition metal ions, lanthanides, actinides, magnetic particles, quantum dots, or a mixture thereof.

10. The method of claim 1, wherein the liquid treatment composition comprises the acid in an amount from 0.1 to 100 wt.-%, based on the total weight of the liquid treatment composition.

11. The method of claim 1, wherein the preselected pattern is a continuous layer, a pattern, a pattern of repetitive elements, a repetitive combination(s) of elements, a one-dimensional bar code, a two-dimensional bar code, a three-dimensional bar code, a QR-code, a dot matrix code, a security mark, a number, a letter, an alphanumeric symbol, a logo, an image, a shape, a signature, a design, or a combination thereof.

12. The method of claim 1, wherein the liquid treatment composition is applied by spray coating, inkjet printing, offset printing, flexographic printing, screen printing, plotting, contact stamping, rotogravure printing, spin coating, reverse (counter-rotating) gravure coating, slot coating, curtain coating, slide bed coating, film press, metered film press, blade coating, brush coating, stamping and/or a pencil.

13. The method of claim 1, wherein the method further comprises a step d) of applying a protective layer above the embedded, UV-visible pattern.

14. A substrate comprising an embedded, UV-visible pattern, obtainable by a method according to claim 1.

15. A product comprising a substrate according to claim 14, wherein the product is a branded product, a security document, a non-secure document, a decorative product, a perfume, a drug, a tobacco product, an alcoholic drug, a bottle, a garment, a packaging, a container, a sporting good, a toy, a game, a mobile phone, a compact disc (CD), a digital video disc (DVD), a blue ray disc, a machine, a tool, a car part, a sticker, a label, a tag, a poster, a passport, a driving licence, a bank card, a credit card, a bond, a ticket, a postage or tax stamp, a banknote, a certificate, a brand authentication tag, a business card, a greeting card, a voucher, a tax banderol, or a wall paper.

16. The substrate of claim 14, wherein the substrate is suitable for use in security applications, in overt security elements, in covert security elements, in brand protection, in microlettering, in micro imaging, in decorative applications, in artistic applications, in visual applications, in packaging applications, or in track and trace applications.

17. The method of claim 1, wherein the salifiable alkaline or alkaline earth compound is a precipitated calcium carbonate.

18. The method of claim 1, wherein the salifiable alkaline or alkaline earth compound is in form of particles having a weight median particle size $d_{50}$ from 100 nm to 10 μm.

19. The method of claim 1, wherein the at least one acid is selected from the group consisting of sulphuric acid, phosphoric acid, boric acid, suberic acid, sulphamic acid, tartaric acid, and mixtures thereof.

20. The method of claim 1, wherein the at least one acid is phosphoric acid and/or sulphuric acid.

* * * * *